US012623270B2

(12) United States Patent
Otsuka et al.

(10) Patent No.: US 12,623,270 B2
(45) Date of Patent: May 12, 2026

(54) BURRING PROCESSING METHOD, BURRING PROCESSING MOLD, BURRING PROCESSING DEVICE, AND BURRING PROCESSED PRODUCT

(71) Applicant: NIPPON STEEL CORPORATION, Tokyo (JP)

(72) Inventors: Kenichiro Otsuka, Tokyo (JP); Masafumi Azuma, Tokyo (JP); Koichi Hamada, Tokyo (JP); Ryo Tabata, Tokyo (JP); Ryo Urushibata, Tokyo (JP); Yuuki Kitahara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 267 days.

(21) Appl. No.: 18/277,348

(22) PCT Filed: Jan. 12, 2022

(86) PCT No.: PCT/JP2022/000722
§ 371 (c)(1),
(2) Date: Aug. 15, 2023

(87) PCT Pub. No.: WO2022/181088
PCT Pub. Date: Sep. 1, 2022

(65) Prior Publication Data

US 2024/0100583 A1 Mar. 28, 2024

(30) Foreign Application Priority Data

Feb. 24, 2021 (JP) ..... 2021-027954

(51) Int. Cl.

| | |
|---|---|
| ***B21D 19/08*** | (2006.01) |
| ***B21D 19/00*** | (2006.01) |
| ***B21D 28/16*** | (2006.01) |
| ***B21D 37/08*** | (2006.01) |

(52) U.S. Cl.
CPC ..... *B21D 19/088* (2013.01); *B21D 37/08* (2013.01)

(58) Field of Classification Search
CPC .... B21D 19/088; B21D 19/005; B21D 37/08; B21D 53/88; B21D 28/16
See application file for complete search history.

(56) References Cited

U.S. PATENT DOCUMENTS

| | | | | |
|---|---|---|---|---|
| 10,384,251 | B2 * | 8/2019 | Isogai | B21D 19/08 |
| 11,065,666 | B2 * | 7/2021 | Ito | B21D 19/08 |

(Continued)

FOREIGN PATENT DOCUMENTS

| | | |
|---|---|---|
| DE | 10 2014 118 363 A1 | 6/2016 |
| EP | 2 295 163 A2 | 3/2011 |

(Continued)

OTHER PUBLICATIONS

English translation (JP2017196632A), retrieved date Jul. 6, 2024.*

(Continued)

*Primary Examiner* — Mohammed S. Alawadi
(74) *Attorney, Agent, or Firm* — Birch, Stewart, Kolasch & Birch, LLP

(57) ABSTRACT

Provided is a burring processing method, which is a method for forming a buffing processed portion including a raised portion and a curved portion in a metal component having a pilot hole formed therein, the method being characterized by including: a preforming step of enlarging a diameter of the pilot hole, moving an edge portion of the pilot hole relative to the metal component in a first direction of a thickness direction of the metal component in a first range around the pilot hole of the metal component, and forming the whole first range into a preformed portion raised from the metal component in the first direction; and a main forming step of deforming the preformed portion in a second direction (Continued)

opposite to the first direction, forming a second range on an outer diameter side of the preformed portion to have the same height as the first range in the first direction, and forming part of a third range on an inner diameter side of the preformed portion from the second range to be part of the curved portion and the raised portion.

4 Claims, 13 Drawing Sheets

(56) References Cited

U.S. PATENT DOCUMENTS

| | | | |
|---|---|---|---|
| 2002/0113041 | A1 | 8/2002 | Ozawa |
| 2012/0073350 | A1 | 3/2012 | Iwata et al. |

FOREIGN PATENT DOCUMENTS

| | | | | |
|---|---|---|---|---|
| EP | 2 886 731 | A1 | | 6/2015 |
| JP | 2004-344968 | A | | 12/2004 |
| JP | 5636846 | B2 | | 12/2014 |
| JP | 2017196632 | A | * | 11/2017 |
| JP | 2018-51609 | A | | 4/2018 |
| JP | 2018051609 | A | * | 4/2018 |

OTHER PUBLICATIONS

English translate (JP2018051609A), retrieved date Sep. 16, 2025.*
English translate (JP2017196632A), retrieved date Sep. 16, 2025.*

* cited by examiner

BURRING PROCESSING METHOD, BURRING PROCESSING MOLD, BURRING PROCESSING DEVICE, AND BURRING PROCESSED PRODUCT

TECHNICAL FIELD

The present invention relates to a burring processing method, a buffing processing mold, a burring processing device, and a burring processed product.

Priority is claimed on Japanese Patent Application No. 2021-027954, filed Feb. 24, 2021, the content of which is incorporated herein by reference.

BACKGROUND ART

There is a technique for forming a burring processed portion having a substantially cylindrical shape by burring a pilot hole provided in a metal component or a metal sheet serving as a workpiece. In this burring process, a circumferential edge portion of the pilot hole is extruded and part thereof is formed into a cylindrical shape to form the burring processed portion. In this burring processed portion, a cylindrical flange (raised portion) is connected to part of the metal component or the metal sheet at a circumferential edge portion thereof via a curved portion. This buffing processed portion is required to have fatigue characteristics and dimensional accuracy. For example, Patent Document 1 discloses a technique for relaxing tensile residual stress by applying compressive stress due to coining to an end portion of a buffing processed portion and inhibiting wrinkles and cracks generated on an inner surface of a bend of a bent portion that constitutes a base of the burring processed portion by locally concentrating compressive stress on the inner surface. In addition, as a technique for burring, a method for performing stepwise forming as described in Patent Document 2 has also been proposed.

CITATION LIST

Patent Document

[Patent Document 1]
Japanese Unexamined Patent Application, First Publication No. 2018-051609
[Patent Document 2]
Japanese Patent No. 5636846

SUMMARY OF THE INVENTION

Problems to be Solved by the Invention

Incidentally, buffing processed portions are also used for vehicle underbody components. In particular, vehicle underbody components such as lower arms and trailing arms are required to have fatigue characteristics, but depending on a burring processing method, tensile residual stress tends to be generated on an inner side of a curved portion of a burring processed portion. If a fatigue load is applied to a component in which tensile residual stress is generated on an inner side of a curved portion of a burring processed portion, the burring processed portion may be deformed. In addition, it is generally known that, depending on a burring processing method, minute cracks (bending inward cracks) of about several tens of μm are generated on the inner side of the curved portion, and a shape change such as enlarging a radius of curvature of the curved portion may be required.

The present invention has been made in view of the above problems, and an object of the present invention is to provide a burring processing method, a burring processing mold, a burring processing device, and a burring processed product in which generation of cracks in a curved portion of a buffing processed portion can be inhibited.

Means for Solving the Problem (1) A burring processing method according to an aspect of the present invention is a method for forming a burring processed portion including a raised portion and a curved portion in a metal component having a pilot hole formed therein, using a burring processing mold including:

a first die that includes a first die hole and a first support surface perpendicular to an axis of the first die hole, and a second die that includes a second die hole and a second support surface perpendicular to an axis of the second die hole;

a holder that includes a third support surface facing the first support surface and the second support surface and holds the metal component between the first die and the second die; and a punch that includes a shaft portion and is movably provided along the axis of the first die hole and the axis of the second die hole, in which the first support surface, the second support surface, and the third support surface are disposed parallel to each other, a diameter of the second die hole is smaller than a diameter of the first die hole, and an outer diameter of the second support surface is smaller than the diameter of the first die hole, the method including:

a preforming step of enlarging a diameter of the pilot hole, moving an edge portion of the pilot hole relative to the metal component in a first direction of a thickness direction of the metal component in a first range around the pilot hole of the metal component and forming the whole first range into a preformed portion raised from the metal component in the first direction; and a main forming step of deforming the preformed portion in a second direction opposite to the first direction, forming a second range on an outer diameter side of the preformed portion to have the same height as the first range in the first direction, and forming part of a third range on an inner diameter side of the preformed portion from the second range to be part of the curved portion and the raised portion, in which an outer diameter of the curved portion is smaller than an outer diameter of the preformed portion, the maximum radius of curvature of the curved portion is smaller than the minimum radius of curvature of the preformed portion in a cross-sectional view parallel to the first direction and passing through a center of the pilot hole, the preformed portion is formed between the punch and the first die by holding the metal component between the first support surface of the first die and the third support surface of the holder and moving the punch relative to the first die in the first direction to insert the punch through the first die hole, the burring processed portion is formed between the second die, the punch, and the holder by moving the second die relative to the holder in the second direction to insert part of the second die between the punch and the first die in a state in which the metal component is held between the first support surface and the third support surface, when a difference between a radius of the first die hole and a radius of the second die hole is defined as U, a diameter of the shaft portion of the punch is defined as P, and the diameter of the pilot hole of the metal component is defined as A, Expression 1 below is satisfied, and when a height of the edge portion of the pilot hole of the metal component is defined as t, and a height of an outer surface of the curved portion in the first direction is defined as h, Expression 2 below is satisfied.

$$0.5\times(P-A)/2<U<20\times(P-A)/2 \quad \text{Expression 1}$$

$$0.2<h/t<0.6 \quad \text{Expression 2}$$

(2) A burring processing method according to an aspect of the present invention is a method for forming a burring processed portion including a raised portion and a curved portion in a metal component having a pilot hole formed therein, using a burring processing mold including a set of preforming molds and a set of main forming molds, the set of preforming molds including:

a first die that includes a first die hole and a first support surface perpendicular to an axis of the first die hole;

a first holder that includes a first holder support surface disposed to face the first support surface and parallel to the first support surface and holds the metal component between the first holder and the first die; and a first punch that includes a first shaft portion and is movably provided along the axis of the first die hole, the set of main forming molds including:

a second die that includes a second die hole and a second support surface perpendicular to an axis of the second die hole;

a second holder that includes a second holder support surface disposed to face the second support surface and parallel to the second support surface and holds the metal component between the second holder and the second die; and a second punch that includes a second shaft portion and is movably provided along the axis of the second die hole, the method including:

a preforming step of enlarging a diameter of the pilot hole, moving an edge portion of the pilot hole relative to the metal component in a first direction of a thickness direction of the metal component in a first range around the pilot hole of the metal component, and forming the whole first range into a preformed portion raised from the metal component in the first direction; and a main forming step of deforming the preformed portion in a second direction opposite to the first direction, forming a second range on an outer diameter side of the preformed portion to have the same height as the first range in the first direction, and forming part of a third range on an inner diameter side of the preformed portion from the second range to be part of the curved portion and the raised portion, in which an outer diameter of the curved portion is smaller than an outer diameter of the preformed portion, the maximum radius of curvature of the curved portion is smaller than the minimum radius of curvature of the preformed portion in a cross-sectional view parallel to the first direction and passing through a center of the pilot hole, the preformed portion is formed between the first punch and the first die by holding the metal component between the first support surface of the first die and the first holder support surface of the first holder and moving the first punch relative to the first die in the first direction to insert the first punch through the first die hole, the metal component in which the preformed portion is formed is separated from the preforming molds, the metal component in which the preformed portion is formed is placed on the second holder support surface of the second holder such that the metal component in which the preformed portion is formed is on the first direction side, the buffing processed portion is formed between the second die, the second punch, and the second holder by inserting the second punch in the first direction into the enlarged pilot hole, and moving the second die relative to the second holder in the second direction to insert the second punch through the second die hole, a diameter of the second die hole is less than or equal to a diameter of the first die hole, and when a height of the edge portion of the pilot hole of the metal component is defined as t, and a height of an outer surface of the curved portion in the first direction is defined as h, Expression 2 below is satisfied.

$$0.2<h/t<0.6 \quad \text{Expression 2}$$

(3) In the burring processing method described in the above (2), when a difference between a radius of the first die hole and a radius of the second die hole is defined as U, a diameter of the second shaft portion of the second punch is defined as Ps, and the diameter of the pilot hole of the metal component is defined as A, Expression 5 below may be satisfied.

$$0.5\times(Ps-A)/2<U<20\times(Ps-A)/2 \quad \text{Expression 5}$$

(4) In the burring processing method described in the above (2) or (3), the second punch may be inserted into the enlarged pilot hole in the first direction, and the second die may be moved in the second direction relative to the second holder.

(5) In the burring processing method described in the above (2) or (3), the second die may be moved in the second direction relative to the second holder, and the second punch may be inserted into the enlarged pilot hole in the first direction.

(6) In the burring processing method according to any one of the above (2) to (5), a diameter of the first shaft portion of the first punch may be smaller than a diameter of the second shaft portion of the second punch.

(7) In the burring processing method according to any one of the above (2) to (6), an initial contact position between the preformed portion and the second die may be in a range from an inner wall side of the second die hole to ⅞ of a surface length of a portion having a curvature of a second die shoulder of the second die hole in the cross-sectional view parallel to the first direction and passing through the center of the pilot hole.

(8) In the burring processing method according to any one of the above (1) to (7), a tensile strength of the metal component may be 780 MPa or more.

(9) In the burring processing method according to any one of the above (1) to (8), when the height of the edge portion of the pilot hole of the metal component is defined as t, and a thickness of an opening side end portion of the raised portion is defined as tb, Expression 4 below may be satisfied.

$$tb/t<0.9 \quad \text{Expression 4}$$

(10) In the burring processing method according to any one of the above (1) to (9), a pilot hole forming step of forming the pilot hole in the metal component before the preforming step may be further included.

(11) A buffing processing mold according to one aspect of the present invention is a buffing processing mold for forming a buffing processed portion including a raised portion and a curved portion in a metal component having a pilot hole formed therein, including:

a first die that includes a first die hole and a first support surface perpendicular to an axis of the first die hole, and a second die that includes a second die hole and a second support surface perpendicular to an axis of the second die hole;

a holder that includes a third support surface facing the first support surface and the second support surface and holds the metal component between the first die and the second die; and a punch that includes a shaft portion and is movably provided along the axis of the first die hole and the axis of the second die hole, in which the first support surface, the second support surface, and the third support surface are disposed parallel to each other, a diameter of the second die hole is smaller than a diameter of the first die hole, and an outer diameter of the second support surface is smaller than the diameter of the first die hole.

(12) A burring processing device according to one aspect of the present invention includes the burring processing mold according to the above (11) and a drive mechanism that causes the first die, the second die, the holder, and the punch to be movable relative to each other.

(13) A burring processed product according to one aspect of the present invention is a burring processed product including a buffing processed portion that includes a raised portion and a curved portion and a peripheral region that surrounds the curved portion, in which, when a radius of curvature of an outer surface of the curved portion in a cross-section including an axis of the burring processed portion and parallel to the axis is defined as R, and when a hardness of the burring processed product at a position a separated by R from an R tangent of the curved portion, at which the curved portion and the peripheral region are connected to each other, toward the peripheral region side in a direction perpendicular to the axis and separated by 0.2 mm in a direction parallel to the axis from a surface on a side at which the raised portion is formed is defined as Hva, and a hardness of the burring processed product at a position b separated by three times R in the direction perpendicular to the axis from the R tangent of the curved portion toward the peripheral region side and separated by ¼ of a thickness of the burring processed product in the peripheral region from the surface on the side at which the raised portion is formed in the direction parallel to the axis is defined as Hvb, Expression 7 below is satisfied, and when the peripheral region has an indentation and a height of the raised portion is defined as Us, the indentation is located in a range of 0.5×Us or more and 20×Us or less from the R tangent of the curved portion, and when the thickness of the burring processed product in the peripheral region is defined as ts, the maximum height or depth of the indentation in the direction parallel to the axis is greater than ts/20 and less than ts/3.

$$Hva/Hvb>1.03 \quad \text{Expression 7}$$

(14) In the burring processed product according to the above (13),

Hva may be an average hardness of hardnesses measured in a range on a cross-section defined by a square centered on the position a and having a side length of ⅙ of the thickness of the burring processed product, and Hvb may be an average hardness of hardnesses measured in a range on a cross-section defined by a square centered on the position b and having a side length of ⅙ of the thickness of the burring processed product.

(15) In the burring processed product according to the above (13) or (14), when the thickness of the buffing processed product in the peripheral region is defined as ts, and a height of the outer surface of the curved portion in the direction parallel to the axis is defined as h, Expression 8 below may be satisfied.

$$0.2<h/ts<0.6 \quad \text{Expression 8}$$

(16) In the burring processed product according to any one of the above (13) to (15), when the thickness of the buffing processed product in the peripheral region is defined as ts, and a thickness of an opening side end portion of the raised portion is defined as tb, Expression 9 below may be satisfied.

$$tb/ts<0.9 \quad \text{Expression9}$$

(17) In the burring processed product according to any one of the above (13) to (16), there may be no cracks having a depth of 20 μm or more from a surface in the cross-section of the curved portion.

(18) The burring processed product according to any one of the above (13) to (17) may be any one of a lower arm, a trailing arm, and an upper arm used in a vehicle.

Effects of the Invention

According to the present invention, it is possible to provide a burring processing method, a buffing processing mold, a burring processing device, and a burring processed product in which generation of cracks in a burring processed portion can be inhibited.

EMBODIMENT FOR IMPLEMENTING THE INVENTION

Figure 1:
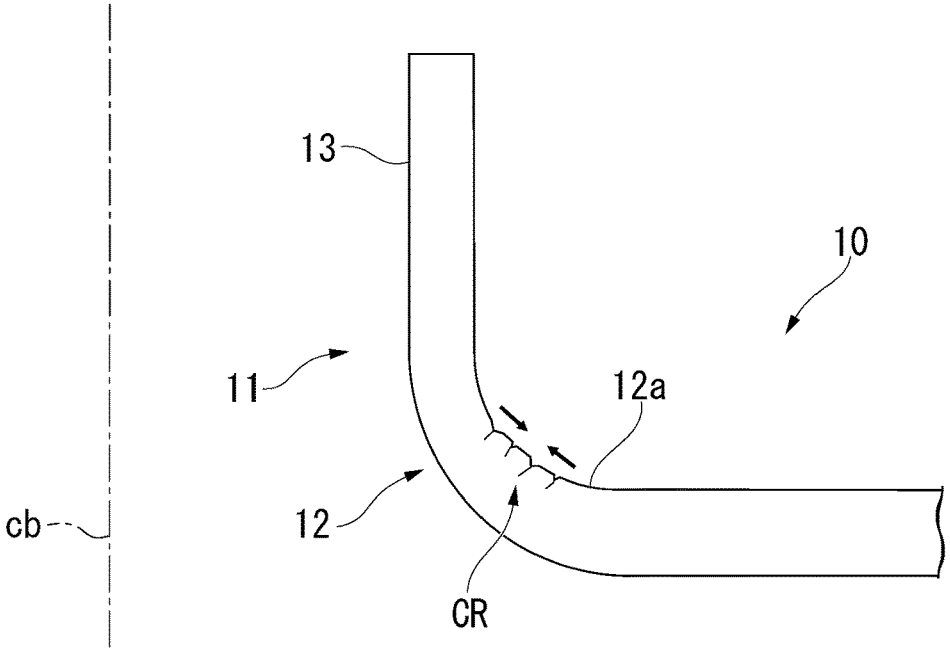
FIG. 1 is a schematic cross-sectional view showing states of compressive strain and bending inward cracks in a curved portion of a burring processed portion.

The present inventors have found that, in a forming process of burring processing, due to generation of unevenness caused by compressive strain generated on an inner surface of a curved portion, the above-described bending inward cracks are generated. FIG. 1 is a schematic cross-sectional view showing states of compressive strain and bending inward cracks in a curved portion of a burring processed portion. FIG. 1 shows a state in which a burring processed product 10 is viewed in its cross-section along a plane passing through an axis cb of a burring processed portion 11 and parallel to the axis cb and shows only one end face of the burring processed portion 11 centered on the axis cb. As shown in FIG. 1, the burring processed portion 11 of the burring processed product 10 has a curved portion 12 and a raised portion 13. During a forming process, compressive strain is generated in arrow directions in the figure on an outer surface 12*a* of the curved portion 12, and bending inward cracks CR are generated starting from unevenness caused by the compressive strain.

The present inventors have found that, in a case in which a radius of curvature of the curved portion of the burring processed portion is extremely smaller than a thickness of a workpiece and the workpiece is a high-strength material, the bending inward cracks may be generated, and these bending inward cracks are generated due to a portion at which the material bulges on the inner surface of the curved portion during the forming process.

Figure 2:
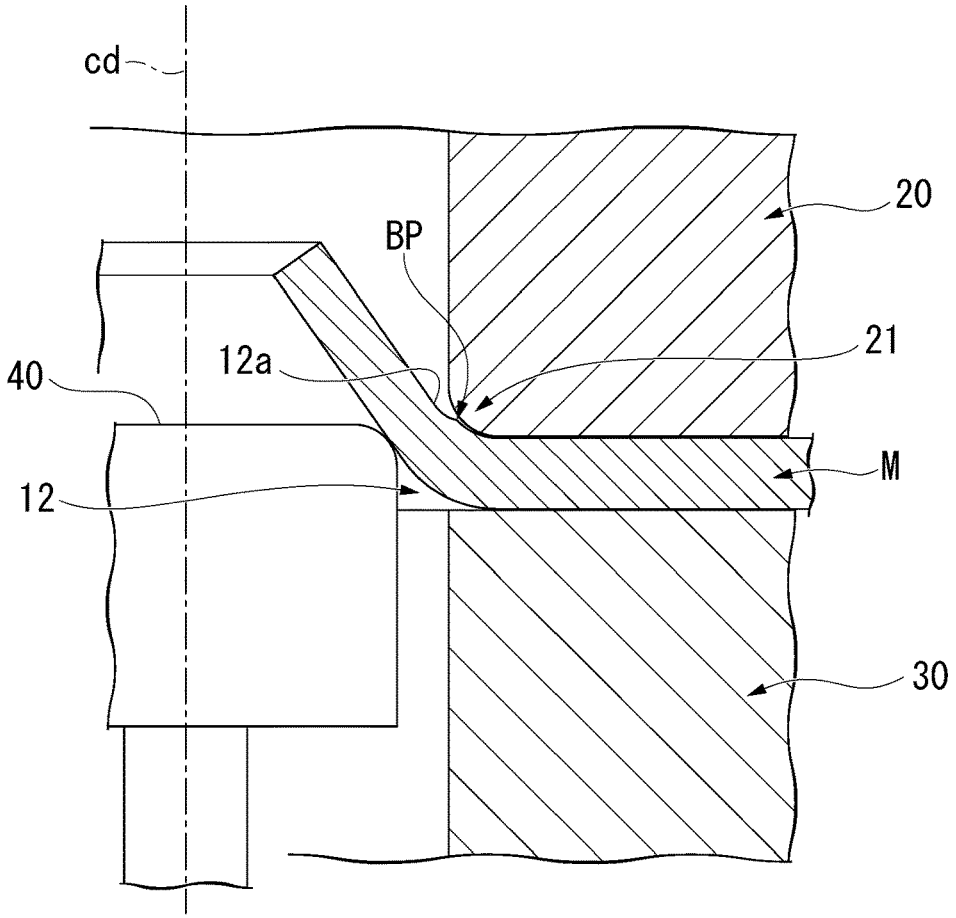
FIG. 2 is a schematic cross-sectional view for explaining a state in which a workpiece (a metal component) bulges in a forming process of burring processing.

FIG. 2 shows a schematic cross-sectional view for explaining a state in which a workpiece bulges during the forming process of burring. FIG. 2 is a diagram showing a state in which, in the forming process of burring, a workpiece M is held between a die 20 and a holder 30 and the workpiece M is deformed by a punch 40 to form the curved portion 12. As illustrated in FIG. 2, in a case in which a radius of curvature of a die shoulder 21 corresponding to the radius of curvature of the curved portion of the burring processed portion is small, especially in an early stage of the forming process, a bulging portion BP is generated on the outer surface 12*a* of the curved portion 12 in contact with the die shoulder 21. Since compressive strain is generated in such a bulging portion BP, it may cause generation of the above-described bending inward cracks. Thus, the present inventors have studied methods for inhibiting such bulging of the material, which causes the compressive strain.

Embodiments of the present invention will be described below with examples, but it is obvious that the present invention is not limited to the examples described below. In the following description, specific numerical values and materials may be exemplified, but other numerical values and materials may be applied as long as the effects of the present invention can be obtained. Also, constituent elements of the following embodiments can be combined with each other.

First Embodiment

A burring processing method according to the present embodiment is a method for forming a buffing processed portion including a raised portion and a curved portion in a metal component having a pilot hole formed therein, using a burring processing mold including: a first die that includes a first die hole and a first support surface perpendicular to an axis of the first die hole; a second die that includes a second die hole and a second support surface perpendicular to an axis of the second die hole; a holder that includes a third support surface facing the first support surface and the second support surface and holds the metal component between the first die and the second die; and a punch that includes a shaft portion and is movably provided along the axis of the first die hole and the axis of the second die hole, in which the first support surface, the second support surface, and the third support surface are disposed parallel to each other, a diameter of the second die hole is smaller than a diameter of the first die hole, and an outer diameter of the second support surface is smaller than the diameter of the first die hole, the method including: a preforming step of enlarging a diameter of the pilot hole, moving an edge portion of the pilot hole relative to the metal component in a first direction of a thickness direction of the metal component in a first range around the pilot hole of the metal component, and forming the whole first range into a preformed portion raised from the metal component in the first direction; and a main forming step of deforming the preformed portion in a second direction opposite to the first direction, forming a second range on an outer diameter side of the preformed portion to have the same height as the first range in the first direction, and forming part of a third range on an inner diameter side of the preformed portion from the second range to be part of the curved portion and the raised portion.

In the buffing processing method, an outer diameter of the curved portion is smaller than an outer diameter of the preformed portion, the maximum radius of curvature of the curved portion is smaller than the minimum radius of curvature of the preformed portion in a cross-sectional view parallel to the first direction and passing through a center of the pilot hole, the preformed portion is formed between the punch and the first die by holding the metal component between the first support surface of the first die and the third support surface of the holder and moving the punch relative to the first die in the first direction to insert the punch through the first die hole, the burring processed portion is formed between the second die, the punch and the holder by moving the second die relative to the holder in the second direction to insert part of the second die between the punch and the first die in a state in which the metal component is held between the first support surface and the third support surface, when a difference between a radius of the first die hole and a radius of the second die hole is defined as U, a diameter of the shaft portion of the punch is defined as P, and the diameter of the pilot hole of the metal component is defined as A, Expression 1 below is satisfied, and when the height of the edge portion of the pilot hole of the metal component is defined as t, and the height of an outer surface of the curved portion in the first direction is defined as h, Expression 2 below is satisfied.

$$0.5\times(P-A)/2<U<20\times(P-A)/2 \quad \text{Expression 1}$$

$$0.2<h/t<0.6 \quad \text{Expression 2}$$

The burring processing method including the above configuration includes the preforming step of forming the preformed portion in one direction around the pilot hole, and the main forming step of deforming the preformed portion in the direction opposite to the one direction to form the raised portion and the curved portion of the burring processed portion, in which the outer diameter of the curved portion is smaller than the outer diameter of the preformed portion, and the maximum radius of curvature of the curved portion is smaller than the minimum radius of curvature of the preformed portion in the cross-sectional view parallel to the first direction and passing through the center of the pilot hole, and thus, generation of cracks in the curved portion of the burring processed portion can be inhibited.

Here, FIGS. 3(A) to 3(C) are schematic plan views for explaining a forming process of known burring and are diagrams viewed in a direction intersecting a surface of a metal component 1. FIG. 3(A) shows the metal component 1 having a pilot hole 2. FIG. 3(B) shows a state in which a circumferential edge portion of the pilot hole 2 is deformed and a diameter of the pilot hole 2 is enlarged. FIG. 3(C) shows a burring processed product 100 for which burring processing is completed. FIGS. 4(A) to 4(C) are schematic cross-sectional views for explaining the forming process of the burring in FIGS. 3(A) to 3(C) and show a cross-section passing through a center of the pilot hole 2, passing through an axis ca perpendicular to the surface of the metal component 1 or an axis cb of a burring processed portion 110 to be formed, and parallel to these axes. Also, in general, the axis ca passing through the center of the pilot hole 2 and perpendicular to the surface of the metal component 1 is aligned with the axis cb of the burring processed portion 110.

Figure 3:
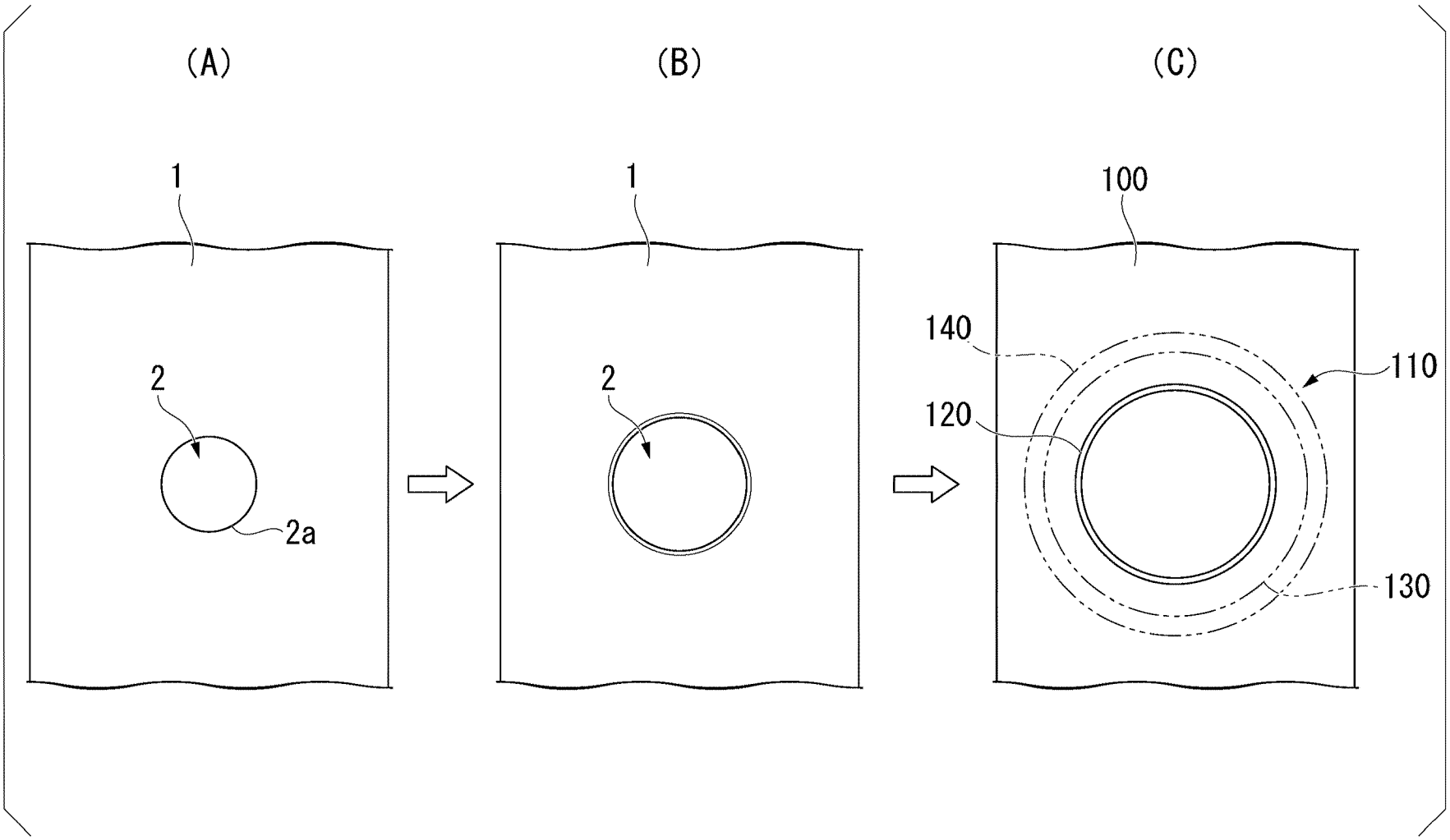
FIGS. 3(A) to 3(C) are schematic plan views for explaining a forming process of known burring processing.
Figure 4:
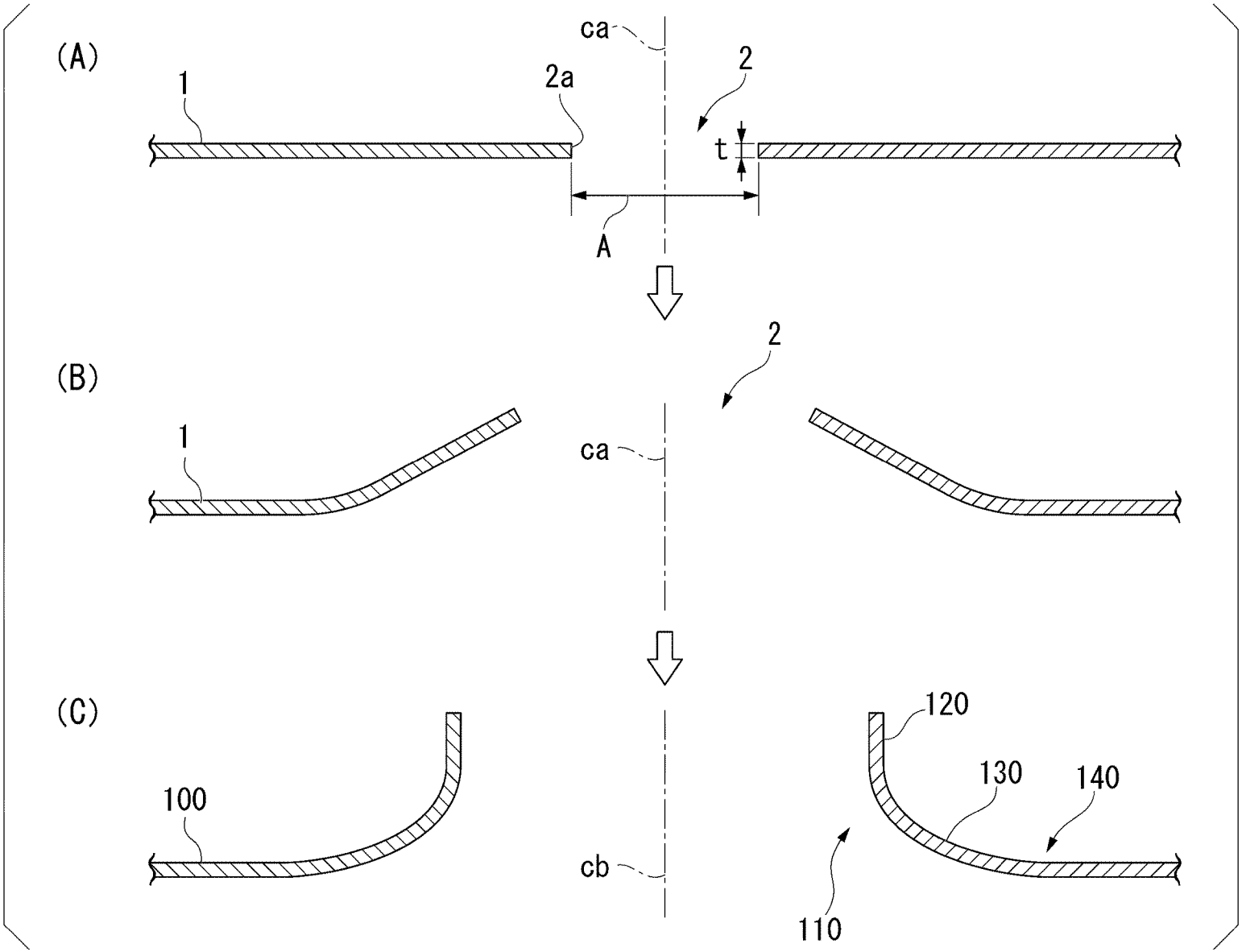
FIGS. 4(A) to 4(C) are schematic cross-sectional views for explaining the forming process of the burring processing in FIGS. 3(A) to 3(C).

In the known burring processing method, as shown in FIGS. 3 and 4, the diameter of the pilot hole 2 provided in the metal component 1 is enlarged and part of the metal component 1 is bent to form the burring processed portion 110 including a raised portion 120 and a curved portion 130. However, depending on a burring processing method, minute cracks (bending inward cracks) may be generated on an inner side of the curved portion 130, and a shape change such as enlarging a radius of curvature of the curved portion 130 may be required. In the burring processing method according to the present embodiment, it is possible to inhibit generation of cracks in such a curved portion of the burring processed portion.

The burring processing method according to the present embodiment will be described below. In the present embodiment, a burring processing method using a burring processing mold 1000 as shown in FIG. 5 will be described.

Figure 5:
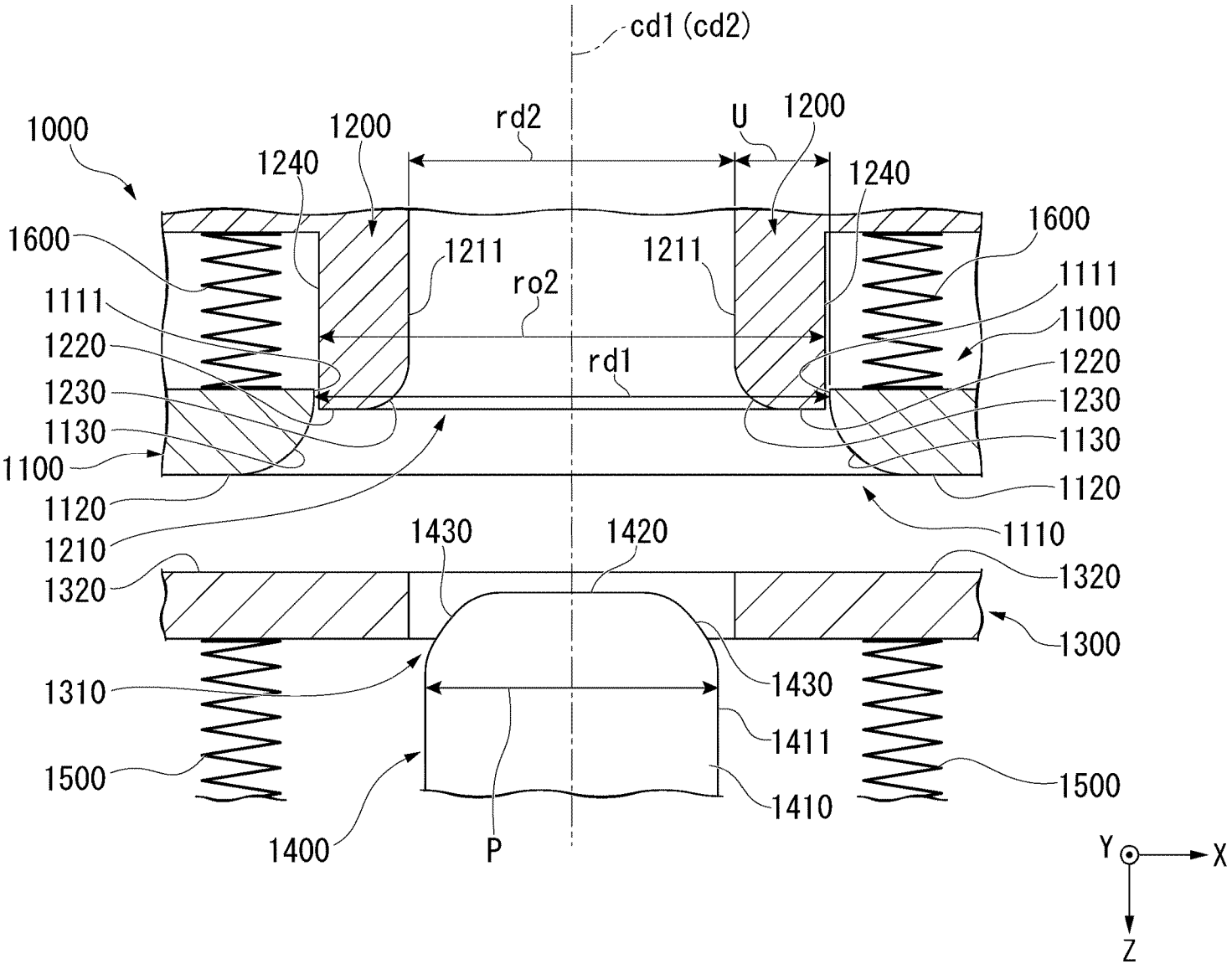
FIG. 5 is a schematic cross-sectional view for explaining a burring processing mold according to a first embodiment.

As shown in FIG. 5, the burring processing mold used in the present embodiment includes a first die 1100 that includes a first die hole 1110 and a first support surface 1120 perpendicular to an axis cd1 of the first die hole 1110, a second die 1200 that includes a second die hole 1210 and a second support surface 1220 perpendicular to an axis cd2 of the second die hole 1210, a holder 1300 that includes a third support surface 1320 facing the first support surface 1120 and the second support surface 1220 and holds the metal component 1 between the first die 1100 and the second die 1200, and a punch 1400 that includes a shaft portion 1410 and is movably provided along the axis cd1 of the first die hole 1110 and the axis cd2 of the second die hole 1210.

The first support surface 1120 and an inner wall surface 1111 of the first die hole 1110 of the first die 1100 and are connected by a first die shoulder surface 1130. The second support surface 1220 and an inner wall surface 1211 of the second die hole 1210 of the second die 1200 are connected by a second die shoulder surface 1230. Also, the second support surface 1220 is connected to a die hole side surface 1240. The die hole side surface 1240 is located on an outer circumferential side of the inner wall surface 1211 of the second die hole 1210. An outer diameter ro2 of the second support surface 1220 is defined as a diameter of the die hole side surface 1240 in a plan view along the axis cd1 of the first die hole 1110. Here, in a case in which a shape of the die hole side surface 1240 in a plan view along the axis cd2 of the second die hole 1210 is a circular shape, the diameter of the die hole side surface 1240 is a diameter thereof. In a case in which the shape of the die hole side surface 1240 in the plan view along the axis cd2 of the second die hole 1210 is not a circular shape, a distance obtained by doubling the largest distance among distances between the axis cd2 of the second die hole 1210 and the die hole side surface 1240 is defined as the diameter of the die hole side surface 1240. The second support surface 1220 and the die hole side surface 1240 may be connected via a ridgeline portion (not shown), but a width of the ridgeline portion may be small. In the example of FIG. 5 and the like, the axis cd1 of the first die hole 1110 and a Z axis are parallel to each other. The Z axis, an X axis, and a Y axis in FIG. 5 and the like are orthogonal to each other.

The punch 1400 having a substantially cylindrical shape includes the shaft portion 1410, and a shaft portion side surface 1411 of the shaft portion 1410 is connected to a top surface 1420 via a punch shoulder surface 1430.

In the burring processing mold 1000, the first support surface 1120, the second support surface 1220, and the third support surface 1320 are disposed parallel to each other. Also, the top surface 1420 of the punch 1400 may be disposed parallel to the first support surface 1120, the second support surface 1220, and the third support surface 1320.

The axis cd1 of the first die hole 1110 and the axis cd2 of the second die hole 1210 coincide with each other. Also, an axis (not shown) of a holder hole 1310 of the holder 1300 coincides with the axis cd1 of the first die hole 1110. Here, an axis of a hole is a line passing through a center of a circular shape drawn by an edge portion of the hole and parallel to a depth direction of the hole. In addition, an axis (not shown) of the punch 1400 coincides with the axis cd1 of the first die hole 1110. Here, the axis of the punch 1400 is an axis of a substantially cylindrical portion of the punch.

In the burring processing mold 1000, a diameter rd2 of the second die hole 1210 is smaller than a diameter rd1 of the first die hole 1110, and the outer diameter rot of the second support surface 1220 is smaller than the diameter rd1 of the first die hole.

In the plan view along the axis cd1 of the first die hole 1110, each of the inner wall surface 1111 of the first die hole 1110, the inner wall surface 1211 of the second die hole 1210, and the shaft portion side surface 1411 of the punch 1400 may be circular. In the plan view along the axis cd1 of the first die hole 1110, the die hole side surface 1240 of the second die 1200 and an inner wall surface of the holder hole 1310 of the holder 1300 may be circular or have other shapes. In the plan view along the axis cd1 of the first die hole 1110, the diameter rd2 of the inner wall surface 1211 of the second die hole 1210 (the diameter of the second die hole 1210) is larger than a diameter of the shaft portion side surface 1411 of the punch 1400, and the diameter rd1 of the inner wall surface 1111 of the first die hole 1110 (the diameter of the first die hole 1110) is larger than the diameter of the inner wall surface 1211 of the second die hole 1210. Further, in the plan view along the axis cd1 of the first die hole 1110, the diameter of the inner wall surface 1111 of the first die hole 1110 is larger than the maximum value of the diameter of the die hole side surface 1240 of the second die 1200.

In the example of FIG. 5, the holder 1300 is connected to springs 1500. For example, the springs 1500 may be connected to a pedestal of the mold on a side opposite to a side connected to the holder 1300. Also, the punch 1400 may be connected to the pedestal of the mold on a side opposite to the top surface 1420 side facing the first die 1100 and second die 1200 sides and may be configured to be movable. Each of the first die 1100, the second die 1200, and the holder 1300 may be connected to a drive unit (not shown) and configured to be independently movable.

A burring processing method using the above-described burring processing mold 1000 will be described below with reference to FIGS. 6 to 10. First, the metal component 1 which is a workpiece is placed on the third support surface 1320 of the holder 1300. In this case, the metal component 1 is preferably placed such that the center of the pilot hole 2 provided in the metal component 1 is located on the axis cd1 of the first die hole 1110. In addition, the example of the present embodiment will be described with a positive direction of the Z axis in FIG. 5 and the like defined as a vertical direction, the direction is not limited thereto. As long as a positional relationship between the burring processing mold 1000 and the metal component 1 can be maintained, the axis cd1 of the first die hole 1110 does not have to be parallel to the vertical direction.

Figure 6:
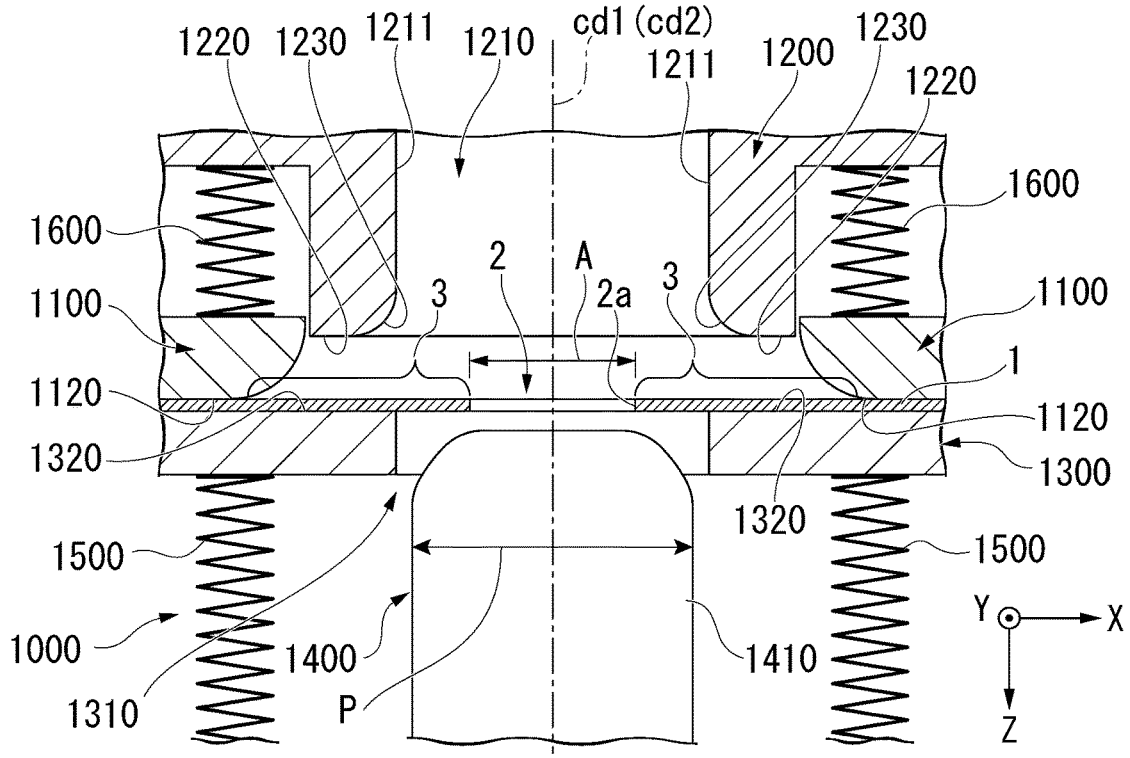
FIG. 6 is a schematic cross-sectional view for explaining a state in which a metal component is held with the burring processing mold.

Next, as shown in FIG. 6, the metal component 1 is held between the first support surface 1120 of the first die 1100 and the third support surface 1320 of the holder 1300.

(Preforming Step)

Next, preforming is performed in a preforming step. In the preforming step, the diameter of the pilot hole 2 is enlarged, an edge portion 2*a* of the pilot hole 2 is moved relative to the metal component 1 in a first direction of a thickness direction of the metal component 1 in a first range 3 around the pilot hole 2 of the metal component 1, and the whole first range 3 is formed to be a preformed portion 4 raised from the metal component 1 in the first direction. The first range 3 is a range defined in the metal component 1, and the preformed portion 4 is formed in the metal component 1 by deforming the first range 3 of the metal component 1. In the present embodiment, the first direction is a negative direction of the Z axis in FIG. 5 and the like, and the second direction described later is a positive direction of the Z axis.

Here, FIG. 9(A) shows a state in which the metal component 1 provided with the pilot hole 2 is viewed in a plan view in a direction perpendicular to the surface of the metal component 1. The pilot hole 2 is defined by the edge portion 2*a* provided on the metal component 1, and a central axis of the pilot hole 2 is defined as ch. FIGS. 9(A) to 9(C) show states viewed in the same direction. FIG. 10(A) is diagram showing a state of the metal component 1 in FIG. 9(A) in a cross-sectional view along a plane passing through the central axis ch. FIGS. 10(A) to 10(C) show states viewed in the same direction. FIG. 9(B) is a diagram showing the metal component 1 provided with the preformed portion 4, which is obtained by deforming the metal component 1 in FIG. 9(A). FIG. 10(A) is a diagram showing a state of the metal component 1 in FIG. 9(A) in a cross-sectional view along a plane through which the central axis ch passes. Here, the thickness direction of the metal component 1 is a direction parallel to the central axis ch of the pilot hole 2. Also, the first direction is a direction in which an edge portion 121 (an opening side end portion) of the raised portion 120 of the burring processed portion 110 faces in the burring processed product 100 after a main forming step.

Figure 7:
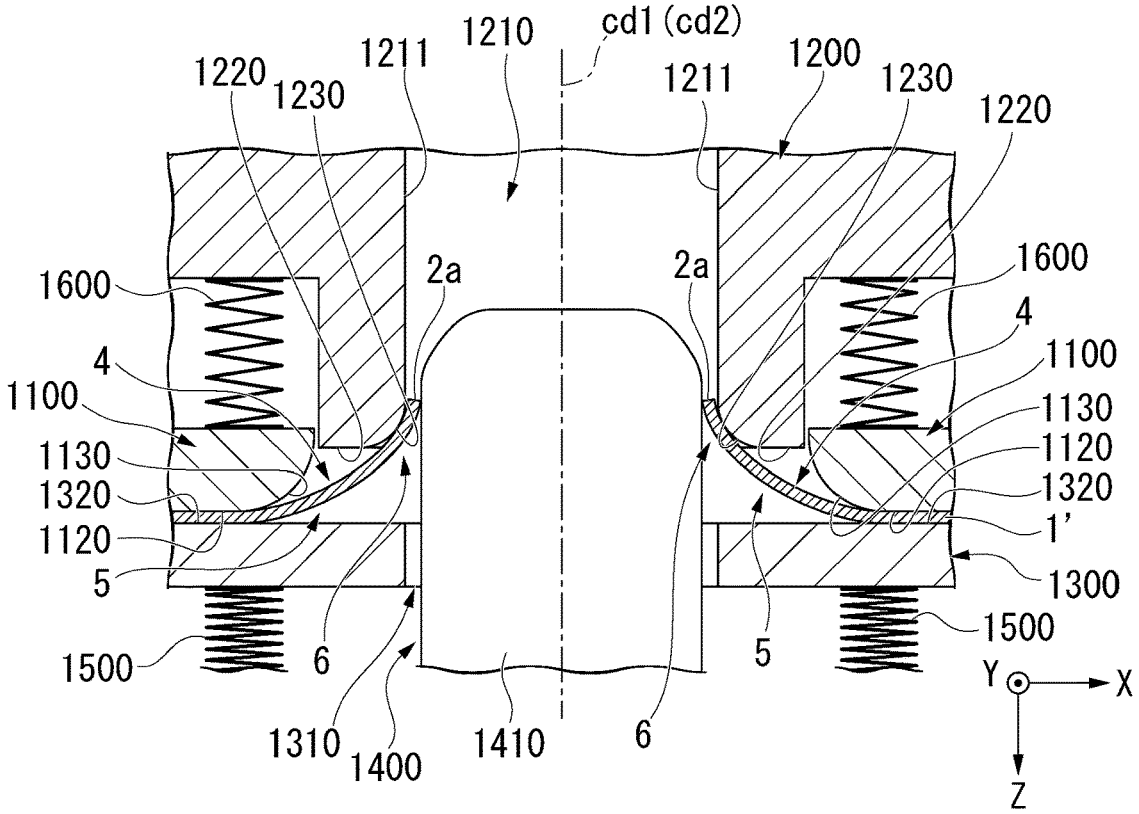
FIG. 7 is a schematic cross-sectional view for explaining the burring processing mold after preforming and the metal component having a preformed portion formed therein.

In the burring processing method according to the present embodiment, the preforming is performed, and thus, in the burring processing mold 1000, by moving the punch 1400 relative to the first die 1100 in the first direction and inserting the punch 1400 through the first die hole 1110, the preformed portion 4 is formed between the punch 1400 and the first die 1100. FIG. 7 shows the burring processing mold 1000 and the metal component 1 after the preforming. As shown in FIG. 7, in the state after the preforming, by inserting the punch 1400 into the pilot hole 2, the diameter of the pilot hole 2 is enlarged, and the whole first range 3 is formed to be the preformed portion 4 raised from the metal component 1 in the first direction. In the state of FIG. 7, by moving the second die 1200 in the second direction, the holder 1300 is moved in the second direction by the first die 1100 connected to the second die 1200 via springs 1600, and the springs 1500 are compressed.

In the example of the present embodiment, the first die 1100 is moved toward the holder 1300, but the present invention is not limited thereto, and the holder 1300 may be moved toward the first die 1100. Also, in the example of the present embodiment, an example in which the first die 1100 and the second die 1200 are moved at the same time has been illustrated, but the present invention is not limited thereto, and the first die 1100 and the second die 1200 may be configured to be independently movable. In the example of FIG. 6 and the like, the first die 1100 and the second die 1200 are connected by the springs 1600. For that reason, by moving the second die 1200 relative to the holder 1300, the first die 1100 also moves relative to the holder 1300 at the same time. Further, in the present embodiment, there are cases in which it is preferable that the edge portion 2*a* of the pilot hole 2 be in contact with the second die shoulder surface 1230 during the preforming, and there are cases in which it is preferable that the edge portion 2*a* be not in contact therewith.

(Main Forming Step)

Subsequently to the preforming step, in the main forming step, the preformed portion 4 is deformed in the second direction opposite to the first direction, a second range 5 on an outer diameter side of the preformed portion 4 is formed to have the same height as the first range 3 in the first direction, and part of a third range 6 on an inner diameter side of the preformed portion 4 from the second range 5 is formed to be part of the curved portion 130 and the raised portion 120 of the burring processed portion 110.

FIG. 9(C) shows a state of the burring processed product 100 provided with the burring processed portion 110 in a plan view from the edge portion 121 side of the raised portion 120 of the burring processed portion 110 along the axis cb of the burring processed portion. The axis cb of the buffing processed portion and the central axis ch of the pilot hole 2 coincide with each other.

Also, as shown in FIG. 9(B), the preformed portion 4 has a circular shape in a plan view in a direction parallel to the central axis ch of the pilot hole 2. The second range 5 is a range included in the preformed portion 4 and is defined as a range on the outer diameter side of the preformed portion 4. Further, the third range 6 is a range included in the preformed portion 4 and is defined as a range on the inner diameter side of the preformed portion 4 from the second range 5. One surface of the preformed portion 4 is located on the first direction side from one surface of the first range 3 before the preforming in a cross-sectional view along a plane passing through the central axis ch.

Figure 8:
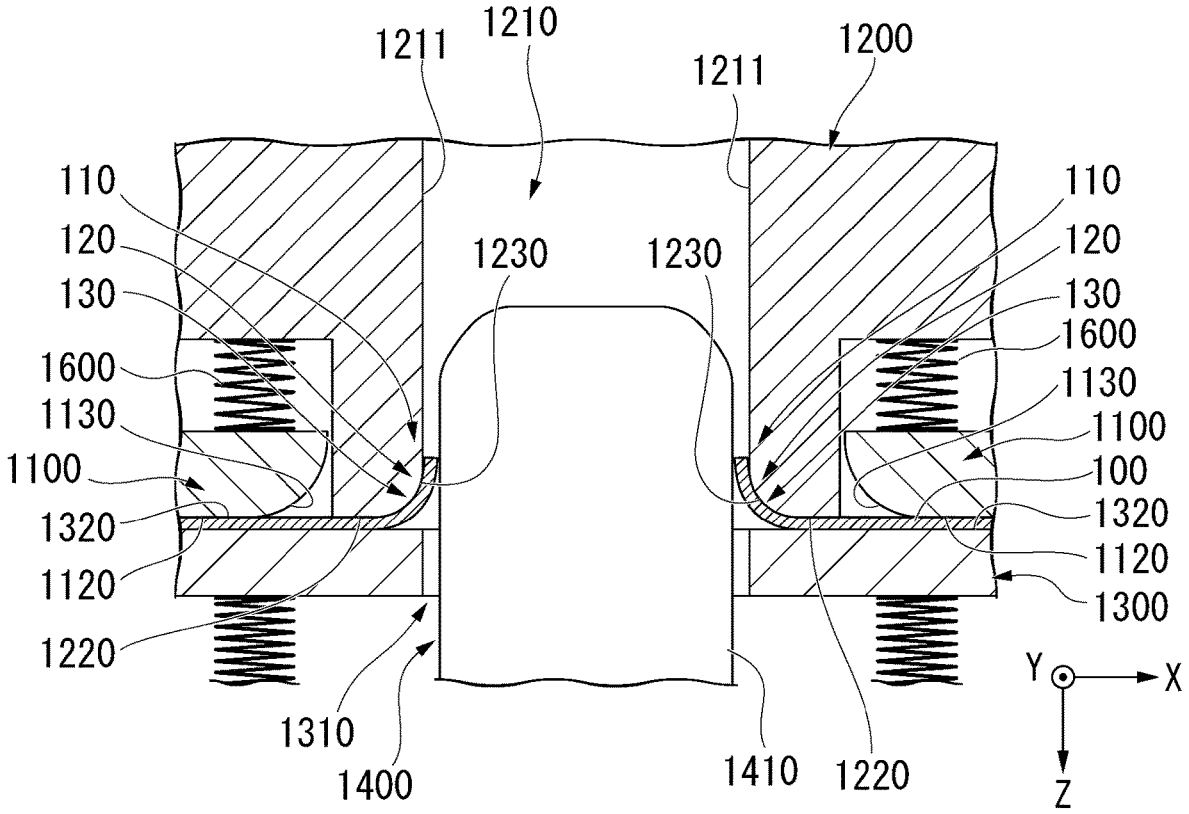
FIG. 8 is a schematic cross-sectional view for explaining the burring processing mold and a burring processed product after main forming.
Figure 9:
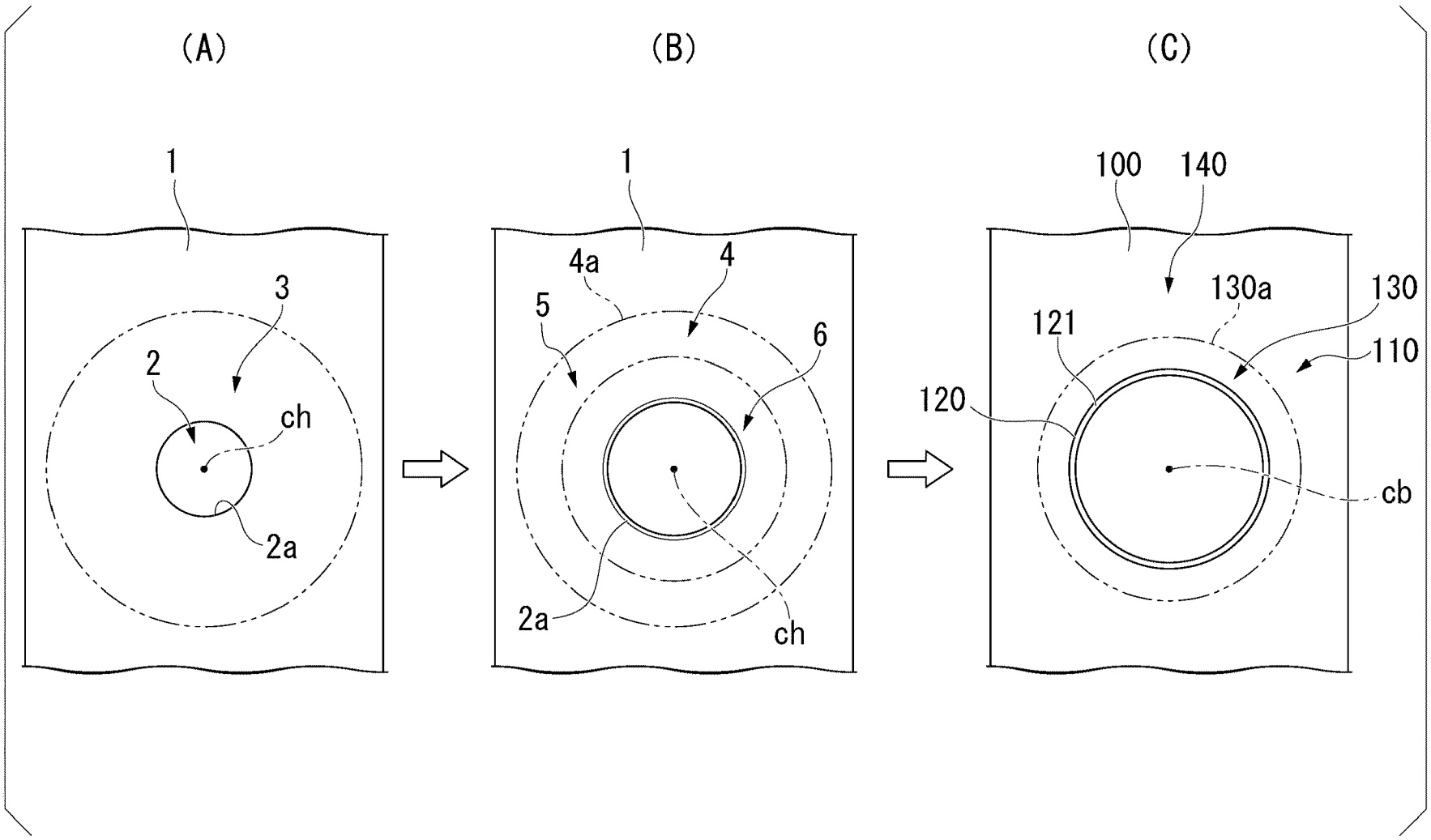
FIGS. 9(A) to 9(C) are schematic plan views for explaining a forming process of a burring processing method according to the first embodiment.
Figure 10:
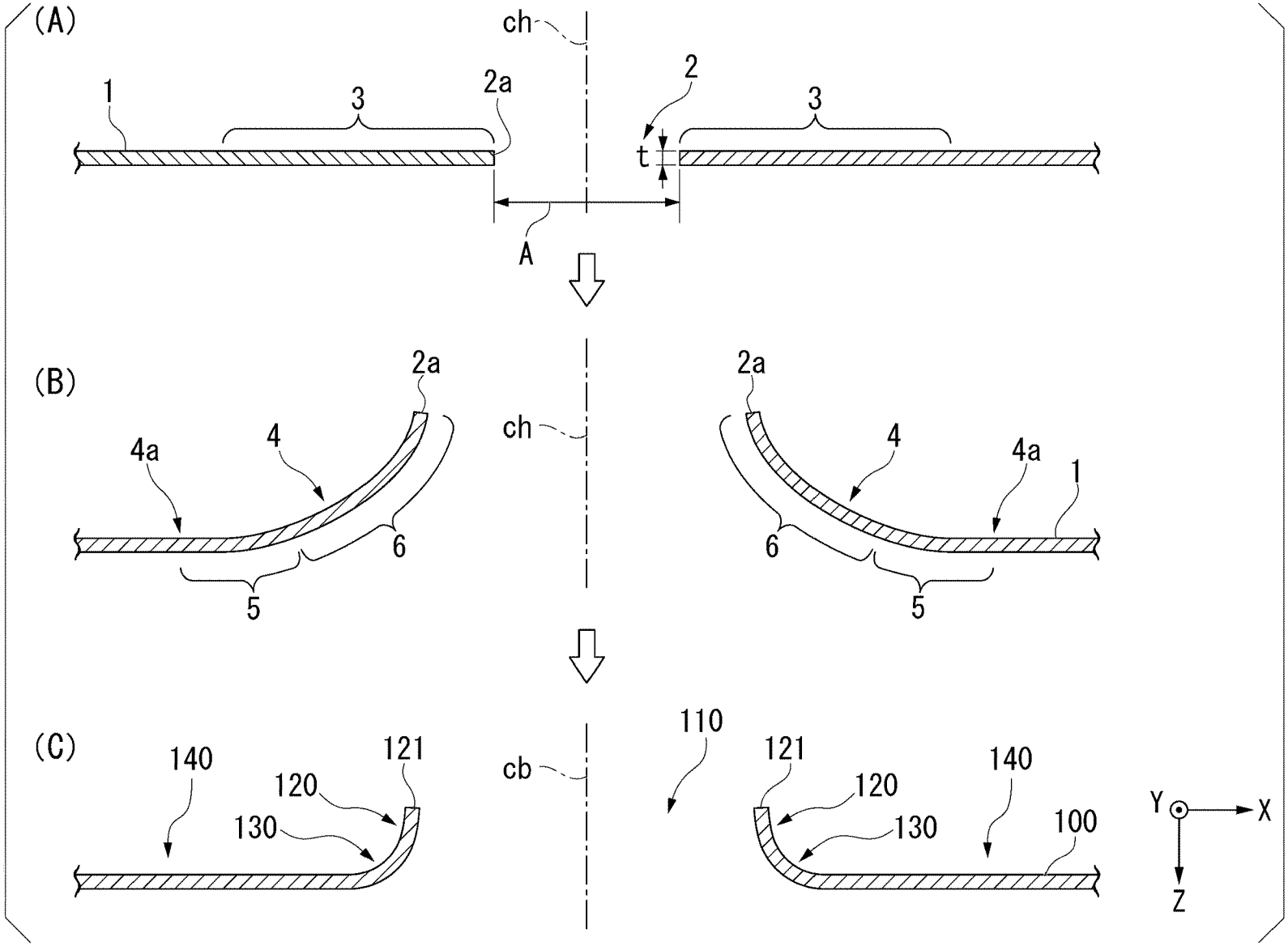
FIGS. 10(A) to 10(C) are schematic cross-sectional views for explaining the forming process of burring in the states of FIGS. 9(A) to 9(C).

In the burring processing method according to the present embodiment, by moving the second die 1200 relative to the holder 1300 in the second direction to insert part of the second die 1200 between the punch 1400 and the first die 1100 in a state in which the metal component 1 is held between the first support surface 1120 and the third support surface 1320, the buffing processed portion 110 is formed between the second die 1200, the punch 1400, and the holder 1300. FIG. 8 shows the burring processing mold 1000 and the burring processed product 100 after the main forming. In the state of FIG. 8, the second die 1200 is further moved in the second direction from the state of FIG. 7, and the springs 1600 are compressed to cause a state in which the second die 1200 and the holder 1300 come closer to each other than in the state of FIG. 7. In the case of connecting the first die 1100 to the second die 1200 with the springs 1600, as in the configuration of the burring processing mold according to the present embodiment, in order to move the first die 1100 and the punch 1400 relative to each other in the preforming step, and then move the second die 1200 and the punch 1400 relative to each other in the main forming step, it is required to make a repulsive force of the springs 1600 greater than a repulsive force of the springs 1500. However, as previously described, each of the first die 1100, the second die 1200, the holder 1300, and the punch 1400 may be configured to move independently.

As shown in FIG. 8, in the state after the main forming, the second die 1200 is inserted between the first die 1100 and the punch 1400, and thus the preformed portion 4 is deformed in the second direction. Thus, the burring processed portion 110 including the raised portion 120 and the curved portion 130 is formed.

Here, in the burring processing method according to the present embodiment, an outer diameter of the preformed portion 4 is an outer diameter of the preformed portion 4 formed into the circular shape in the plan view in the direction parallel to the central axis ch of the pilot hole 2. The outer diameter of the preformed portion 4 can also be rephrased as an outer diameter of the circular shape defined by an edge portion 4*a* of the preformed portion 4 as shown in FIG. 9(B). The edge portion 4*a* of the preformed portion 4 can be defined as a boundary between a surface at the same height as the one surface of the first range 3 before the preforming and a surface located on the first direction side of the one surface of the first range 3 before the preforming. In the burring processing method according to the present embodiment, an indentation (including a bending trace), which will be described later, is formed in a range including the edge portion 4*a* and its vicinity due to the preforming step.

In the above-described burring processing method, an outer diameter of the curved portion 130 is an outer diameter of the curved portion 130 formed into a circular shape in a plan view in a direction parallel to the axis cb of the burring processed portion 110. The outer diameter of the curved portion 130 can also be rephrased as an outer diameter of a circular shape defined by an edge portion 130*a* of the curved portion 130 as shown in FIG. 9(C). The edge portion 130*a* of the curved portion 130 can be defined as a boundary between a surface at the same height as one surface of the first range 3 before the preforming and a surface located on the first direction side of the one surface of the first range 3 before the preforming.

In the above-described burring processing method, the radius of curvature of the curved portion 130 is a radius of curvature in a cross-sectional view parallel to the first direction and passing through the center of the pilot hole 2. Here, the first direction coincides with the axis cb of the burring processed portion 110. In other words, the cross-section parallel to the first direction and passing through the center of the pilot hole 2 is a cross-section parallel to the axis cb of the burring processed portion 110 and including the axis cb of the burring processed portion 110. The curved portion 130 may have a constant radius of curvature in this cross-sectional view, or the radius of curvature may vary in the curved portion 130. The maximum radius of curvature of the curved portion 130 is the largest radius of curvature among radii of curvature of the curved portion 130 in the cross-sectional view parallel to the first direction and passing through the center of the pilot hole 2. A concave surface among surfaces of the curved portion 130, that is, a shape of an outer surface of the burring processed portion 110 corresponds to a shape of the second die shoulder surface 1230 of the second die 1200.

Similarly, the preformed portion 4 may have a constant radius of curvature in the cross-sectional view parallel to the first direction and passing through the center of the pilot hole 2, or the radius of curvature may vary in the preformed portion 4. The maximum radius of curvature of the preformed portion 4 is the largest radius of curvature among radii of curvature of the preformed portion 4 in the cross-sectional view parallel to the first direction and passing through the center of the pilot hole 2.

The buffing processing method according to the present embodiment includes the preforming step and the main forming step, the outer diameter of the curved portion is smaller than the outer diameter of the preformed portion, and the maximum radius of curvature of the curved portion is smaller than the minimum radius of curvature of the preformed portion in the cross-sectional view parallel to the first direction and passing through the center of the pilot hole, whereby compressive strain generated in the curved portion can be inhibited, and generation of cracks in the curved portion of the burring processed portion can be inhibited.

Also, in the burring processing method according to the present embodiment, when a difference between a radius of the first die hole 1110 and a radius of the second die hole 1210 is defined as U, a diameter of the shaft portion of the punch 1400 is defined as P, and the diameter of the pilot hole 2 of the metal component 1 is defined as A, Expression 1 below is satisfied. By satisfying Expression 1, the appropriate preformed portion 4 can be formed in the preforming step, and concentration of the compressive strain can be inhibited in the main forming step. By setting U to be less than 20×(P−A)/2, a contact area between the second die 1200 and the metal component 1 can be secured, and the bulging portion can be inhibited, thereby inhibiting generation of bending inward cracks. By setting U to be more than 0.5×(P−A)/2, a contact distance between the second die 1200 and the preformed portion 4 of the metal component 1 in the main forming step is shortened, and thus the bulging portion can be inhibited, thereby inhibiting generation of bending inward cracks. Here, the difference U between the radius of the first die hole 1110 and the radius of the second die hole 1210 can be expressed as (rd1−rd2)/2 using the diameter rd1 of the first die hole 1110 and the diameter rd2 of the second die hole 1210.

$$0.5\times(P-A)/2<U<20\times(P-A)/2 \qquad \text{Expression 1}$$

Further, in the burring processing method according to the present embodiment, when the height of the edge portion 2*a* of the pilot hole 2 of the metal component 1 is defined as t, and the height of the outer surface of the curved portion 130 in the first direction is defined as h, Expression 2 below is satisfied.

$$0.2<h/t<0.6 \qquad \text{Expression 2}$$

The bending inward cracks described above are more likely to be generated as h/t becomes smaller. The reason for this is that, as h/t becomes smaller, a bend radius of the curved portion 130 of the burring processed portion 110 becomes smaller with respect to a sheet thickness, compressive strain of a bend inner surface layer becomes larger, and the bulging portion is formed more significantly. Effects of the burring processing method according to the present embodiment are exhibited more remarkably when h/t is less than 0.6. In addition, since the compressive strain in the bending becomes excessive when h/t is 0.2 or less, there is a possibility that formation of the bulging portion cannot be inhibited and bending inward cracks may be generated, and thus h/t is set to be more than 0.2.

In addition, by setting h/t within the above range, there is an advantage that a range of the raised portion 120 can be increased. Here, the height of the edge portion 2*a* of the pilot hole 2 of the metal component 1 is, in other words, a thickness (sheet thickness) of the metal component 1 at the edge portion 2*a* of the pilot hole 2. The thickness of the metal component 1 at the edge portion 2*a* of the pilot hole 2 may be an average value of values measured at a plurality of locations (for example, 5 locations) using a measuring instrument such as a micrometer or vernier caliper.

Further, in the burring processing method according to the present embodiment, when the difference between the radius of the first die hole 1110 and the radius of the second die hole 1210 is defined as U, the diameter of the shaft portion of the punch 1400 is defined as P, the diameter of the pilot hole 2 of the metal component 1 is defined as A, and the height of the edge portion 2*a* of the pilot hole 2 of the metal component 1 is t, Expression 3 below may be satisfied.

$$2.0\times(P-A)/2/t<U<80\times(P-A)/2/t \qquad \text{Expression 3}$$

By satisfying Expression 3, a width of the sheet thickness t and behavior of the metal component 1 in the preforming step can be taken into consideration, and generation of the bending inward cracks can be further inhibited.

The burring processing method according to the present embodiment has the advantage that buffing can be performed in one step without performing exchange of molds or the like.

In the buffing processing method according to the present embodiment, a steel member having a tensile strength of 780 MPa or more is preferably used for the metal component 1. For the metal component 1, a steel member having a tensile strength of 980 MPa or more or a steel member having a tensile strength of 1180 MPa or more is more preferably used. A tensile strength of the metal component 1 is measured by taking a JIS No. 5 tensile test piece described in JIS Z 2201 from the metal component 1 and performing a tensile test according to JIS Z 2241:2011.

In the burring processing method according to the present embodiment, the thickness of the metal component is preferably 1.8 to 4.2 mm, and more preferably 2.0 to 3.9 mm. The thickness of the metal component is more preferably 2.3 to 3.2 mm. By setting the thickness of the metal component within such a range, desired rigidity and lightness can be ensured. The thickness of the metal component may be an average value of values measured at a plurality of locations (for example, 5 locations) of flat portions in the metal component, except for the pilot hole and non-flat portions being subjected to bending, using a measuring instrument such as a micrometer and vernier caliper.

In the burring processing method according to the present embodiment, when the height of the edge portion 2*a* of the pilot hole 2 of the metal component 1 is defined as t, and a thickness of the opening side end portion (edge portion 121) of the raised portion 120 is defined as tb, Expression 4 below may be satisfied. Thus, there is the advantage that the range of the raised portion can be increased. The thickness tb may be an average value of values measured at a plurality of locations (for example, 5 locations) using a measuring instrument such as a micrometer or vernier caliper.

$$tb/t<0.9 \qquad \text{Expression 4}$$

The burring processing method according to the present embodiment may further include a pilot hole forming step of forming the pilot hole 2 in the metal component 1 before the preforming step.

Also, according to the present invention, a burring processing mold for use in the burring processing method according to the first embodiment is provided, the burring processing mold being characterized by including a first die that includes a first die hole and a first support surface perpendicular to an axis of the first die hole, a second die that includes a second die hole and a second support surface perpendicular to an axis of the second die hole, a holder that includes a third support surface facing the first support surface and the second support surface and holds a metal component between the first die and the second die, and a punch that includes a shaft portion and is movably provided along the axis of the first die hole and the axis of the second die hole, in which the first support surface, the second support surface, and the third support surface are disposed parallel to each other, a diameter of the second die hole is smaller than a diameter of the first die hole, and an outer diameter of the second support surface is smaller than the diameter of the first die hole. Further, according to the present invention, a burring processing device including a drive mechanism that can cause the first die, the second die, the holder, and the punch of the burring processing mold described in the first embodiment to move relative to each other is provided.

Second Embodiment

A burring processing method according to the present embodiment is a method for forming a buffing processed portion including a raised portion and a curved portion in a metal component having a pilot hole formed therein, the method being characterized by including: a preforming step of enlarging a diameter of the pilot hole, moving an edge portion of the pilot hole relative to the metal component in a first direction of a thickness direction of the metal component in a first range around the pilot hole of the metal component, and forming the whole first range into a preformed portion raised from the metal component in the first direction; and a main forming step of deforming the preformed portion in a second direction opposite to the first direction, forming a second range on an outer diameter side of the preformed portion to have the same height as the first range in the first direction, and forming part of a third range on an inner diameter side of the preformed portion from the second range to be part of the curved portion and the raised portion, in which an outer diameter of the curved portion is smaller than an outer diameter of the preformed portion, and the maximum radius of curvature of the curved portion is smaller than the minimum radius of curvature of the preformed portion in a cross-sectional view parallel to the first direction and passing through a center of the pilot hole.

The burring processing method according to the present embodiment uses a burring processing mold including a set of preforming molds including a first die that includes a first die hole and a first support surface perpendicular to an axis of the first die hole, a first holder that includes a first holder support surface disposed to face the first support surface and parallel to the first support surface and holds the metal component between the first holder and the first die, and a first punch that includes a first shaft portion and is movably provided along the axis of the first die hole, and a set of main forming molds including a second die that includes a second die hole and a second support surface perpendicular to an axis of the second die hole, a second holder that includes a second holder support surface disposed to face the second support surface and parallel to the second support surface and holds the metal component between the second holder and the second die, and a second punch that includes a second shaft portion and is movably provided along the axis of the second die hole, and a diameter of the second die hole is less than or equal to a diameter of the first die hole.

Also, in the buffing processing method according to the present embodiment, the preformed portion is formed between the first punch and the first die by holding the metal component between the first support surface of the first die and the first holder support surface of the first holder and moving the first punch relative to the first die in the first direction to insert the first punch through the first die hole, the metal component in which the preformed portion is formed is separated from the preforming molds, then, the metal component in which the preformed portion is formed is placed on the second holder support surface of the second holder such that the metal component in which the preformed portion is formed is on the first direction side, the burring processed portion is formed between the second die, the second punch, and the second holder by inserting the second punch in the first direction into the enlarged pilot hole, and moving the second die relative to the second holder in the second direction to insert the second punch through the second die hole, and when the height of the edge portion of the pilot hole of the metal component is defined as t, and the height of an outer surface of the curved portion in the first direction is defined as h, Expression 2 below is satisfied.

$$0.2<h/t<0.6 \qquad \text{Expression 2}$$

The burring processing method having the above configuration includes the preforming step of forming the preformed portion in one direction around the pilot hole, and the main forming step of deforming the preformed portion in the direction opposite to the one direction to form the raised portion and the curved portion of the burring processed portion, the outer diameter of the curved portion is smaller than the outer diameter of the preformed portion, and the maximum radius of curvature of the curved portion is less than the minimum radius of curvature of the preformed portion in the cross-sectional view parallel to the first direction and passing through the center of the pilot hole, and thus generation of cracks in the curved portion of the buffing processed portion can be inhibited.

The burring processing method according to the present embodiment will be described below. Also, in the burring processing method according to the present embodiment, since the shape of the metal component 1, which is the workpiece, is similar in the process of forming the metal component 1 to be the burring processed product 100, the description will be omitted as appropriate. In addition, definitions of the first direction, the second direction, the axes, and the like are also the same as in the first embodiment. Processes of deformation of the metal component 1 according to the present embodiment are the same as the processes shown in FIGS. 9(A) to 9(C) and FIGS. 10(A) to 10(C) described in the first embodiment.

Figure 11:
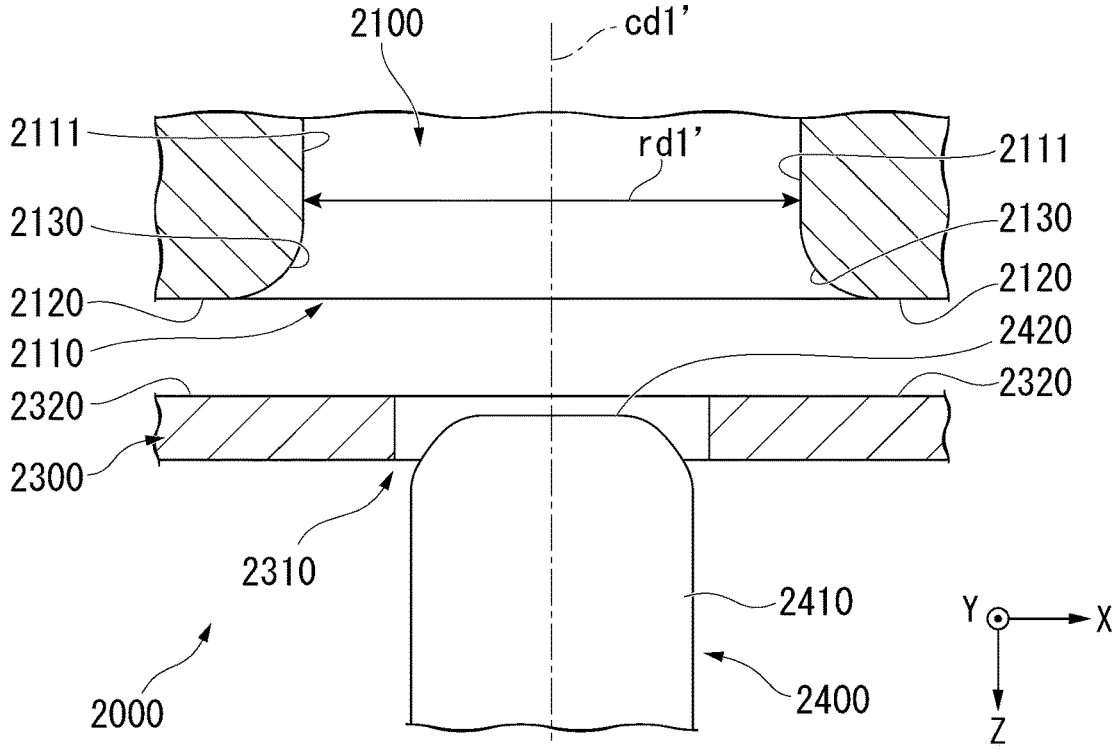
FIG. 11 is a schematic cross-sectional view for explaining a preforming mold of a burring processing mold according to a second embodiment.

In the burring processing method according to the present embodiment, a preforming mold 2000 as shown in FIG. 11 is used in the preforming step. The preforming mold 2000 includes a first die 2100 that includes a first die hole 2110 and a first support surface 2120 perpendicular to an axis cd1' of the first die hole, a first holder 2300 that includes a first holder support surface 2320 disposed to face the first support surface 2120 and parallel to the first support surface 2120 and holds the metal component 1 between itself and the first die 2100, and a first punch 2400 that includes a first shaft portion 2410 and is movably provided along the axis cd1' of the first die hole 2110.

Figure 12:
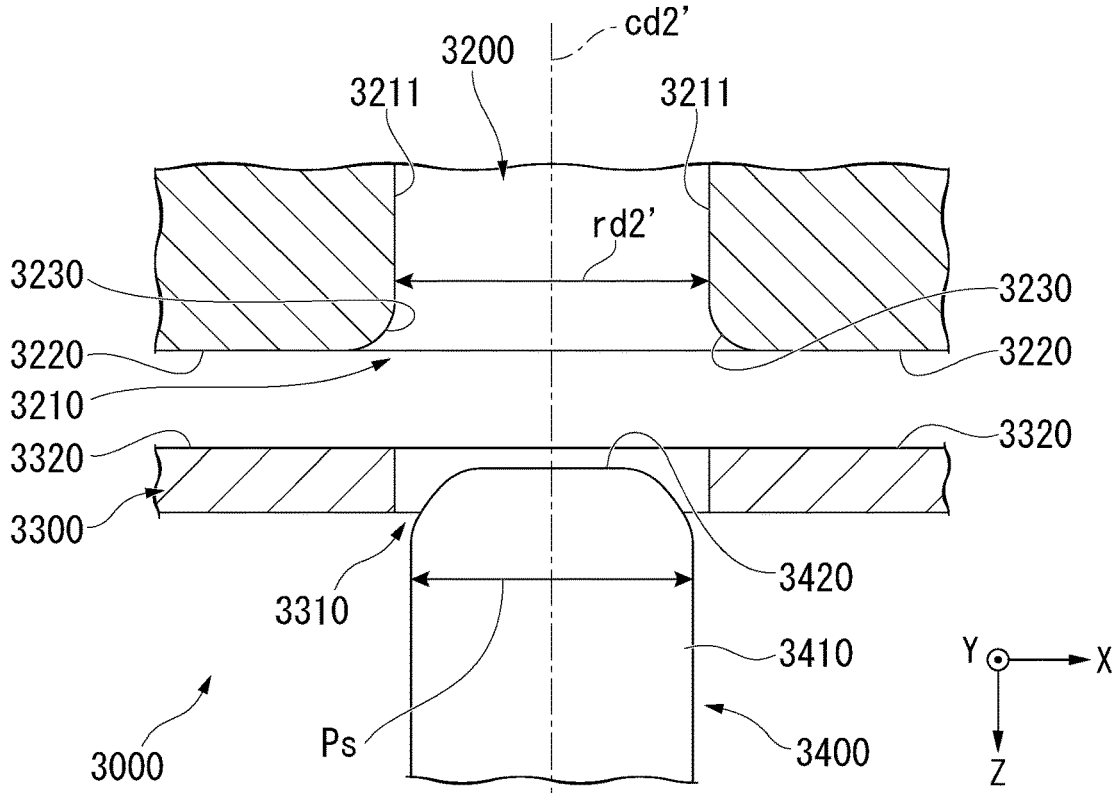
FIG. 12 is a schematic cross-sectional view for explaining a main forming mold of the burring processing mold according to the second embodiment.

Also, in the burring processing method according to the present embodiment, a main forming mold 3000 as shown in FIG. 12 is used in the main forming step. The main forming mold 3000 includes a second die 3200 that includes a second die hole 3210 and a second support surface 3220 perpendicular to an axis cd2' of the second die hole 3210, a second holder 3300 that includes a second holder support surface 3320 disposed to face the second support surface 3220 and parallel to the second support surface 3220 and holds the metal component 1 having the preformed portion 4 formed therein between itself and the second die 3200, and a second punch 3400 that includes a second shaft portion 3410 and is movably provided along the axis cd2' of the second die hole 3210.

In addition, in the preforming mold 2000 and the main forming mold 3000 according to the present embodiment, a diameter of the second die hole 3210 is less than or equal to a diameter of the first die hole 2110.

In the burring processing method according to the present embodiment, first, the metal component 1 provided with the pilot hole is placed on the preforming mold 2000 as in the first embodiment. Then, the metal component 1 is held between the first support surface 2120 of the first die 2100 and the first holder support surface 2320 of the first holder 2300.

Figure 13:
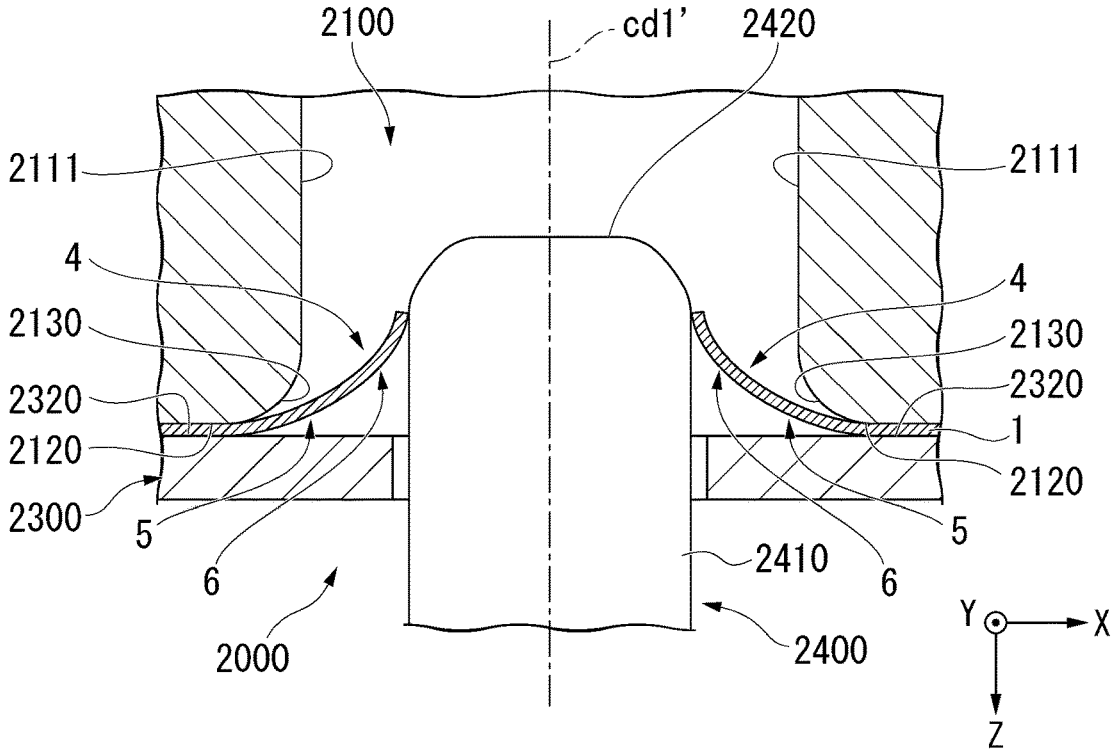
FIG. 13 is a schematic cross-sectional view for explaining the preforming mold after preforming and a metal component having a preformed portion formed therein according to the second embodiment.

Next, in order to perform preforming, in the preforming mold 2000, by moving the first punch 2400 relative to the first die 2100 in the first direction to insert the first punch 2400 through the first die hole 2110, the preformed portion 4 is formed between the first punch 2400 and the first die 2100. FIG. 13 shows the preforming mold 2000 and the metal component 1 after the preforming.

After the preforming is performed, the metal component 1 in which the preformed portion 4 is formed is separated from the preforming mold 2000. In the burring processing method according to the present embodiment, an indentation (including a bending trace), which will be described later, is formed in a range including the edge portion 4*a* and its vicinity due to the preforming step.

Figure 14:
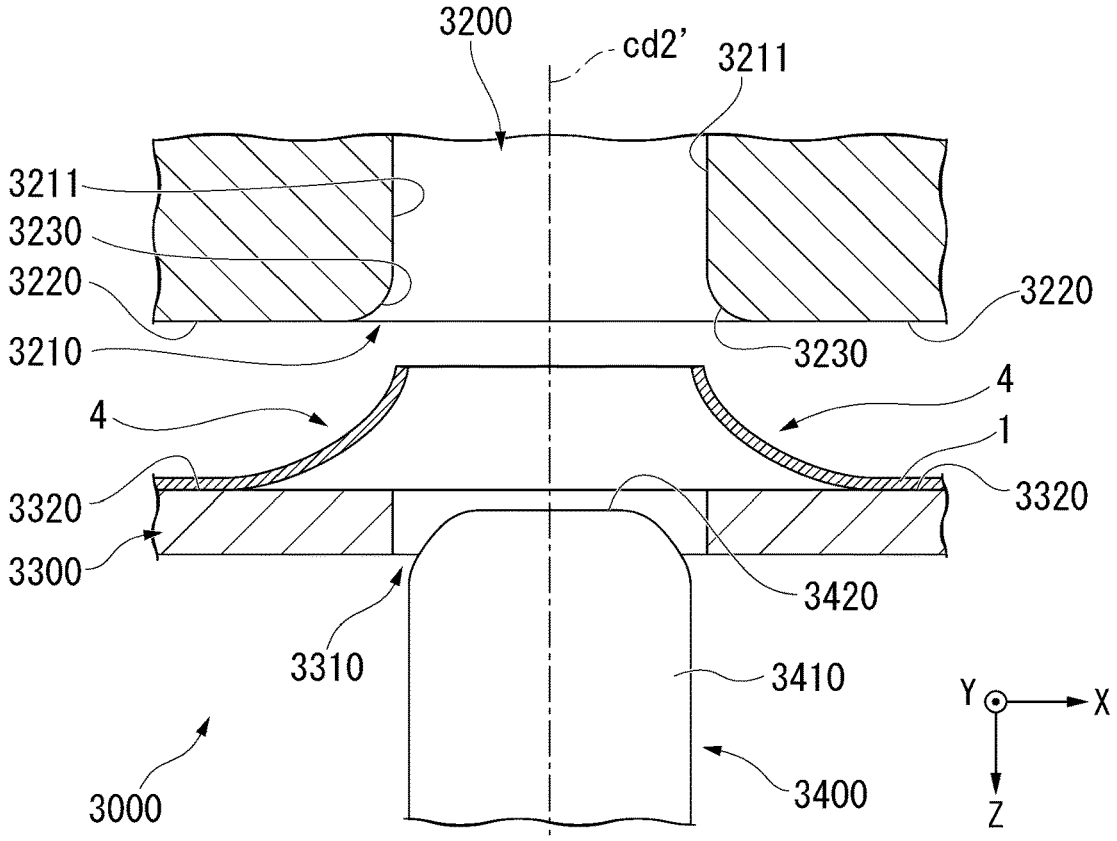
FIG. 14 is a schematic cross-sectional view for explaining a state in which the metal component having the preformed portion formed therein is placed on the main forming mold according to the second embodiment.

Next, as shown in FIG. 14, the metal component 1 is placed on the second holder support surface 3320 of the second holder 3300 of the main forming mold 3000 such that the metal component 1 in which the preformed portion 4 is formed is located on the first direction side.

In the burring processing method according to the present embodiment, in order to perform the main forming, by inserting the second punch 3400 in the first direction into the enlarged pilot hole 2, moving the second die 3200 in the second direction relative to the second holder 3300, and inserting the second punch 3400 through the second die hole 3210, the burring processed portion 110 is formed between the second die 3200, the second punch 3400, and the second holder 3300.

In the burring processing method according to the present embodiment, when the height of the edge portion 2*a* of the pilot hole 2 of the metal component 1 is defined as t, and the height of the outer surface of the curved portion 130 in the first direction is defined as h, Expression 2 below is satisfied.

$$0.2<h/t<0.6 \qquad \text{Expression 2}$$

The bending inward cracks described above are more likely to be generated as h/t becomes smaller. The reason for this is that, as h/t becomes smaller, the bend radius of the curved portion 130 of the burring processed portion 110 becomes smaller with respect to the sheet thickness, the compressive strain of the bend inner surface layer becomes larger, and the bulging portion is formed more significantly. Effects of the buffing processing method according to the present embodiment are exhibited more remarkably when h/t is less than 0.6. In addition, since the compressive strain in the bend becomes excessive when h/t is 0.2 or less, there is a possibility that formation of the bulging portion cannot be inhibited and the bending inward cracks may be generated, and thus h/t is set to be more than 0.2.

In addition, by setting h/t within the above range, there is an advantage that the range of the raised portion 120 can be increased. Here, the height of the edge portion 2*a* of the pilot hole 2 of the metal component 1 is, in other words, the thickness (sheet thickness) of the metal component 1 at the edge portion 2*a* of the pilot hole 2. The thickness of the metal component 1 at the edge portion 2*a* of the pilot hole 2 may be an average value of values measured at a plurality of locations (for example, 5 locations) using a measuring instrument such as a micrometer or vernier caliper.

In the buffing processing method according to the present embodiment, when a difference between a radius of the first die hole 2110 and a radius of the second die hole 3210 is defined as U, a diameter of the second shaft portion 3410 of the second punch 3400 is defined as Ps, and the diameter of the pilot hole 2 of the metal component 1 is defined as A, Expression 5 below may be satisfied. By satisfying Expression 5, the appropriate preformed portion 4 can be formed in the preforming step, and concentration of the compressive strain can be inhibited in the main forming step. By setting U to be less than 20×(Ps−A)/2, a contact area between the second die 3200 and the metal component 1 can be secured, and the bulging portion can be inhibited, thereby inhibiting generation of the bending inward cracks. By setting U to be more than 0.5×(Ps−A)/2, a contact distance between the second die 3200 and the preformed portion 4 of the metal component 1 in the main forming step is shortened, and thus the bulging portion can be inhibited, thereby inhibiting generation of the bending inward cracks. Here, the difference U between the radius of the first die hole 2110 and the radius of the second die hole 3210 can be expressed as (rd1'−rd2')/2 using a diameter rd1' of an inner wall surface 2111 of the first die hole 2110 and a diameter rd2' of an inner wall surface 3211 of the second die hole 3210.

$$0.5\times(Ps-A)/2<U<20\times(Ps-A)/2 \qquad \text{Expression 5}$$

Also, in the buffing processing method according to the present embodiment, the difference between the radius of the first die hole 2110 and the radius of the second die hole 3210 is defined as U, the diameter of the second shaft portion 3410 of the second punch 3400 is defined as Ps, the diameter of the pilot hole 2 of the metal component 1 is defined as A, and the height of the edge portion 2*a* of the pilot hole 2 of the metal component 1 is defined as t, Expression 6 below may be satisfied.

$$2.0\times(Ps-A)/2/t<U<80\times(Ps-A)/2/t \qquad \text{Expression 6}$$

By satisfying Expression 6, a width of the sheet thickness t and behavior of the metal component 1 in the preforming step can be taken into consideration, and generation of the bending inward cracks can be further inhibited.

In the main forming step of the buffing processing method according to the present embodiment, the main forming can be performed by two methods as described below.

Figure 15:
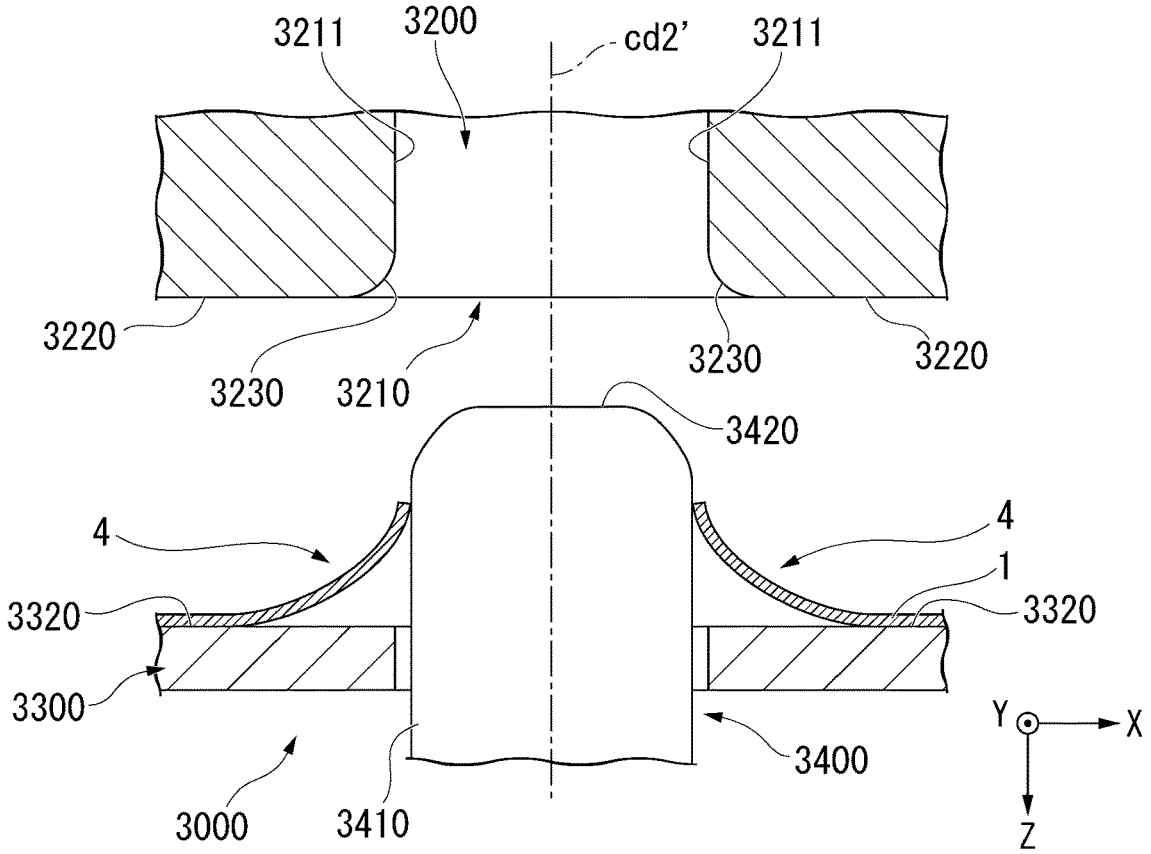
FIG. 15 is a schematic cross-sectional view for explaining a state in which a second punch is inserted into an enlarged pilot hole from the state of FIG. 14 in the main forming mold according to the second embodiment.
Figure 16:
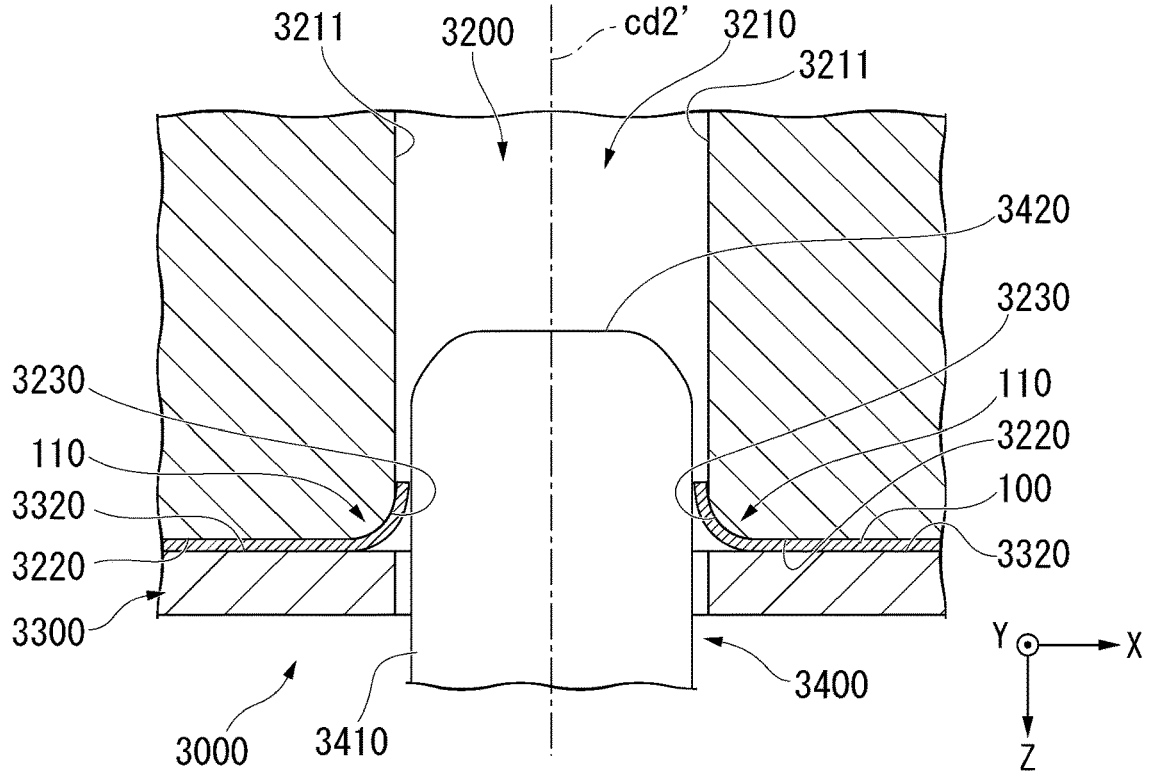
FIG. 16 is a schematic cross-sectional view for explaining a state in which a second die is moved relative to a second holder from the state of FIG. 15 to form the burring processed portion in the main forming mold according to the second embodiment.

In the burring processing method according to the present embodiment, as a first method, as shown in FIG. 15, first, the second punch 3400 may be inserted into the enlarged pilot hole 2 in the first direction. The second die 3200 is moved in the second direction relative to the second holder 3300 in the state shown in FIG. 15, which leads to the state shown in FIG. 16, and the burring processed product 100 in which the burring processed portion 110 is formed is obtained.

Figure 17:
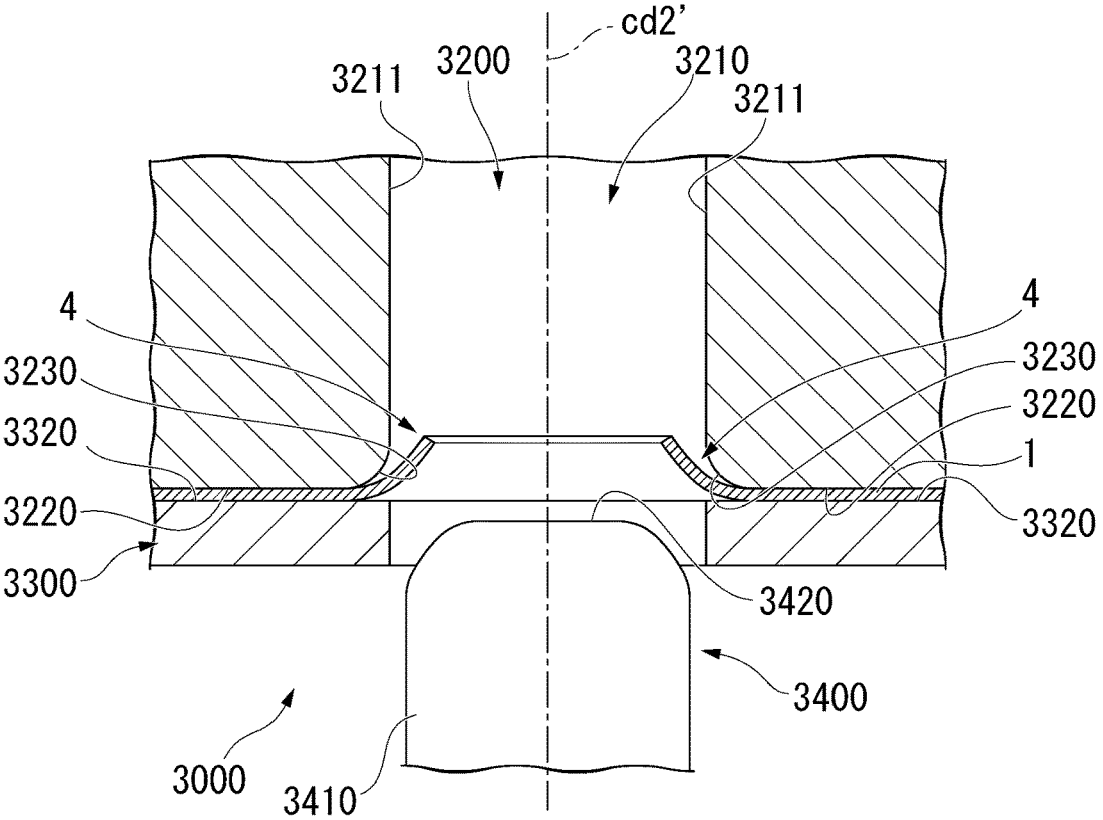
FIG. 17 is a schematic cross-sectional view for explaining a state in which the second die is moved relative to the second holder from the state of FIG. 14 to form the preformed portion in the main forming mold according to the second embodiment.

As a second method, as shown in FIG. 17, first, the second die 3200 is moved in the second direction relative to the second holder 3300. The metal component 1 having the preformed portion 4 formed therein is pressed by the second support surface 3220 of the second die 3200 and the second holder support surface 3320 of the second holder 3300 and deformed in the second direction. In this state, as shown in FIG. 17, part of the preformed portion 4 formed through the preforming step remains around the pilot hole 2. Next, the second punch 3400 is inserted in the first direction into the enlarged pilot hole 2, which leads to the state shown in FIG. 16, and the burring processed product 100 in which the burring processed portion 110 is formed is obtained.

In the buffing processing method according to the present embodiment, a diameter of the first shaft portion 2410 of the first punch 2400 may be smaller than a diameter of the second shaft portion 3410 of the second punch 3400. Thus, there is an advantage that the height of the raised portion can be increased. Also, the diameter of the first shaft portion 2410 of the first punch 2400 and the diameter of the second shaft portion 3410 of the second punch 3400 may be the same.

In the buffing processing method according to the present embodiment, an initial contact position between the preformed portion 4 and the second die 3200 may be in a range from the inner wall surface 3211 side of the second die hole 3210 to ⅞ of a surface length of a portion having a curvature of the second die shoulder surface 3230 of the second die hole 3210 in a cross-sectional view parallel to the first direction and passing through the center of the pilot hole 2. Thus, concentration of compressive strain in the main forming step can be more effectively inhibited.

In the burring processing method according to the present embodiment, the first punch 2400 used in the preforming step may be used as the above-described second punch 3400 in the main forming step. That is, after the preforming is performed, the main forming may be performed by changing the first die 2100 to the second die 3200 without separating the metal component 1 having the preformed portion 4 formed therein from the first punch 2400 and the first holder 2300.

The burring processing method according to the present embodiment is excellent in that it does not require a mold having a special structure. In addition, in the example of the present embodiment, illustration of springs connected to the first die 2100, the second die 3200, the first holder 2300, or the second holder 3300 has been omitted, but each mold may be connected to springs, and a configuration similar to that of the first embodiment can be adopted. The first die 2100, the second die 3200, the first holder 2300, and the second holder 3300 may each be connected to a drive unit (not shown) and configured to be independently movable. Also, the first punch 2400 (or the second punch 3400) is connected to a pedestal of a mold on a side opposite to a top surface 2420 (or top surface 3420) side facing the first die 2100 (or the second die 3200) side or may be configured to be movable.

In the burring processing method according to the present embodiment, a steel member having a tensile strength of 780 MPa or more is preferably used for the metal component 1. For the metal component 1, a steel member having a tensile strength of 980 MPa or more or a steel member having a tensile strength of 1180 MPa or more is more preferably used. A tensile strength of the metal component 1 is measured by taking a JIS No. 5 tensile test piece described in JIS Z 2201 from the metal component 1 and performing a tensile test according to JIS Z 2241:2011.

In the burring processing method according to the present embodiment, the thickness of the metal component is preferably 1.8 to 4.2 mm, and more preferably 2.0 to 3.9 mm. The thickness of the metal component is more preferably 2.3 to 3.2 mm. By setting the thickness of the metal component within such a range, desired rigidity and lightness can be ensured. The thickness of the metal component may be an average value of values measured at a plurality of locations (for example, 5 locations) of flat portions in the metal component, except for the pilot hole and non-flat portions being subjected to bending, using a measuring instrument such as a micrometer and vernier caliper.

In the burring processing method according to the present embodiment, when the height of the edge portion 2*a* of the pilot hole 2 of the metal component 1 is defined as t, and the thickness of the opening side end portion (edge portion 121) of the raised portion 120 is defined as tb, Expression 4 below may be satisfied. Thus, there is an advantage that the range of the raised portion can be increased. The thickness tb may be an average value of values measured at a plurality of locations (for example, 5 locations) using a measuring instrument such as a micrometer or vernier caliper.

$$tb/t<0.9 \qquad \text{Expression 4}$$

The burring processing method according to the present embodiment may further include the pilot hole forming step of forming the pilot hole 2 in the metal component 1 before the preforming step.

Also, according to the present invention, a burring processing mold for use in the burring processing method according to the second embodiment is provided, the burring processing mold being characterized by including the first die that includes the first die hole and the first support surface perpendicular to the axis of the first die hole, the second die that includes the second die hole and the second support surface perpendicular to the axis of the second die hole, the holder that includes the third support surface facing the first support surface and the second support surface and holds the metal component between the first die and the second die, and the punch that includes the shaft portion and is movably provided along the axis of the first die hole and the axis of the second die hole, in which the first support surface, the second support surface, and the third support surface are disposed parallel to each other, the diameter of the second die hole is smaller than the diameter of the first die hole, and the outer diameter of the second support surface is smaller than the diameter of the first die hole. Further, according to the present invention, a burring processing device including a drive mechanism that can cause the first die, the second die, the holder, and the punch of the buffing processing mold described in the second embodiment to move relative to each other is provided.

Third Embodiment

A burring processed product according to the present embodiment is a burring processed product including a burring processed portion that includes a raised portion and a curved portion and a peripheral region that surrounds the curved portion. In the burring processed product according to the present embodiment, in a cross-section including an axis of the burring processed portion and parallel to the axis, when a radius of curvature of an outer surface of the curved portion is defined as R, and when a hardness of the buffing processed product at a position a separated by R from an R tangent of the curved portion, at which the curved portion and the peripheral region are connected to each other, toward the peripheral region side in a direction perpendicular to the axis and separated by 0.2 mm in a direction parallel to the axis from a surface on a side at which the raised portion is formed is defined as Hva, and a hardness of the burring processed product at a position b separated by three times of R in the direction perpendicular to the axis from the R tangent of the curved portion toward the peripheral region side and separated by ¼ of a thickness of the buffing processed product in the peripheral region from the surface on the side at which the raised portion is formed in the direction parallel to the axis is defined as Hvb, Expression 7 below is satisfied, and when the peripheral region has an indentation and the height of the raised portion is defined as Us, the indentation is located in a range of 0.5×Us or more and 20×Us or less from the R tangent of the curved portion, and when the thickness of the burring processed product in the peripheral region is defined as ts, the maximum height or depth of the indentation in the direction parallel to the axis is greater than ts/20 and less than ts/3.

$$Hva/Hvb > 1.03 \qquad \text{Expression 7}$$

The burring processed product having the above configuration has an advantage of high collision resistance.

Here, the hardness Hva and the hardness Hvb can be measured by a method described in JIS Z 2244.

Figure 18:
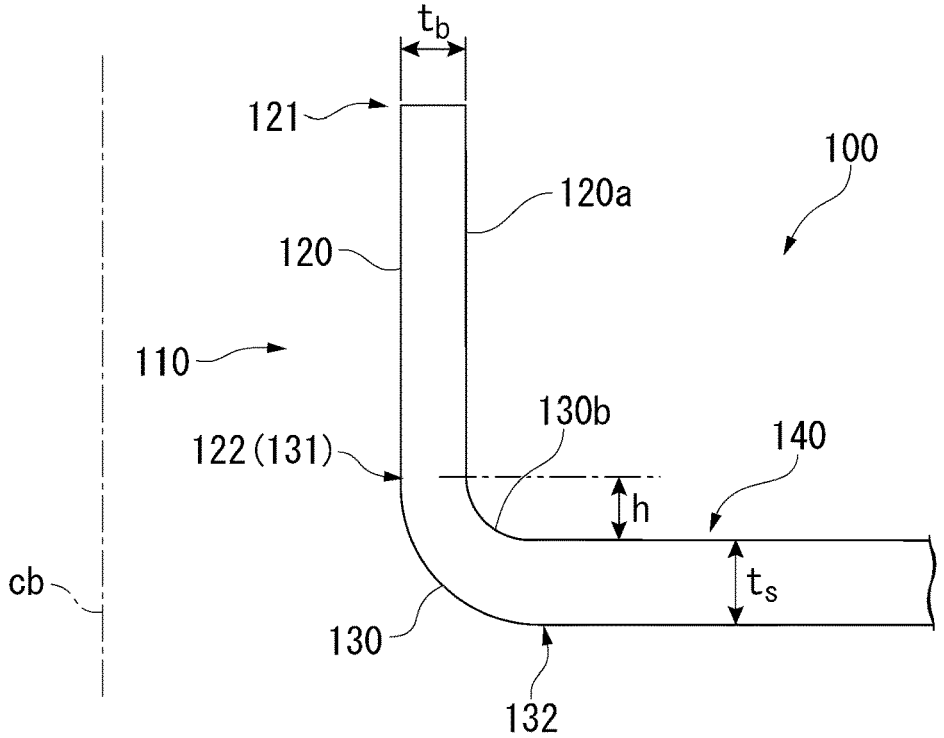
FIG. 18 is a schematic cross-sectional view for explaining a burring processed product according to a third embodiment.

FIG. 18 is a diagram for explaining the burring processed product 100 according to the present embodiment and is a cross-sectional view of a cross-section passing through the axis cb of the burring processed portion 110 and parallel to the axis cb of the burring processed portion 110. FIG. 18 shows only one side of the burring processed portion 110 around the axis cb. As shown in FIG. 18, the burring processed portion 110 according to the present embodiment includes the raised portion 120 having a cylindrical shape and the curved portion 130. The raised portion 120 is connected to the curved portion 130 at a connecting end portion 122 on a side opposite to the opening side end portion 121 of the raised portion 120.

The curved portion 130 is connected to the connecting end portion 122 of the raised portion 120 at a tip portion 131 and is connected to the peripheral region 140 of the burring processed product 100 via a base end portion 132 on a side opposite to the tip portion 131. The connecting end portion 122 and the tip portion 131 may be located at the same location. A diameter of the curved portion 130 is enlarged from the tip portion 131 toward the base end portion 132. The curved portion 130 is smoothly curved in the cross-section passing through the axis cb of the burring processed portion 110 and parallel to the axis cb of the burring processed portion 110. The axis cb of the burring processed portion 110 is an axis passing through an axis of a longitudinal direction of the raised portion 120 having a cylindrical shape.

The peripheral region 140 is a region surrounding the curved portion 130 of the burring processed product 100 and is a region connected to the base end portion 132 of the curved portion 130. The peripheral region 140 more preferably has a width of about 0.5 to 50.0 mm in a radial direction of the burring processed portion 110 in a plane perpendicular to the axis cb of the burring processed portion 110, although it depends on a shape of the burring processed product 100. The thickness of the burring processed product in the peripheral region 140 is defined as ts. The thickness ts may be an average value of values obtained by measuring a plurality of locations (for example, 5 locations) of the peripheral region 140 using a measuring instrument such as a micrometer or vernier caliper.

In the buffing processed product according to the present embodiment, Hva may be an average hardness of hardnesses measured in a range defined by a square Sa centered on the position a and having a side length of ⅙ of the thickness of the burring processed product in a cross-section including the axis of the burring processed portion and parallel to the axis. Also, Hvb may be an average hardness of hardnesses measured in a range defined by a square Sb centered on the position b and having a side length of ⅙ of the thickness of the buffing processed product in the cross-section including the axis of the burring processed portion and parallel to the axis. Each of these squares is located such that at least one side is parallel to the axis of the buffing processed portion in the cross-section including the axis of the burring processed portion and parallel to the axis. That is, in each of these squares, two sides parallel to each other are parallel to the axis of the burring processed portion, and two sides perpendicular to these sides are perpendicular to the axis of the burring processed portion. The square Sa is centered on the position a. That is, distances from the position a to each vertex of the square Sa are equal. The same applies to a relationship between the square Sb and the position b.

The average hardness is an average value of 3 to 11 samples obtained from the range defined by each square. Also, the thickness of the burring processed product may be an average value of values obtained by measuring a plurality of locations (for example, 5 locations) in the peripheral region 140 using a measuring instrument such as a micrometer or vernier caliper.

Figure 19:
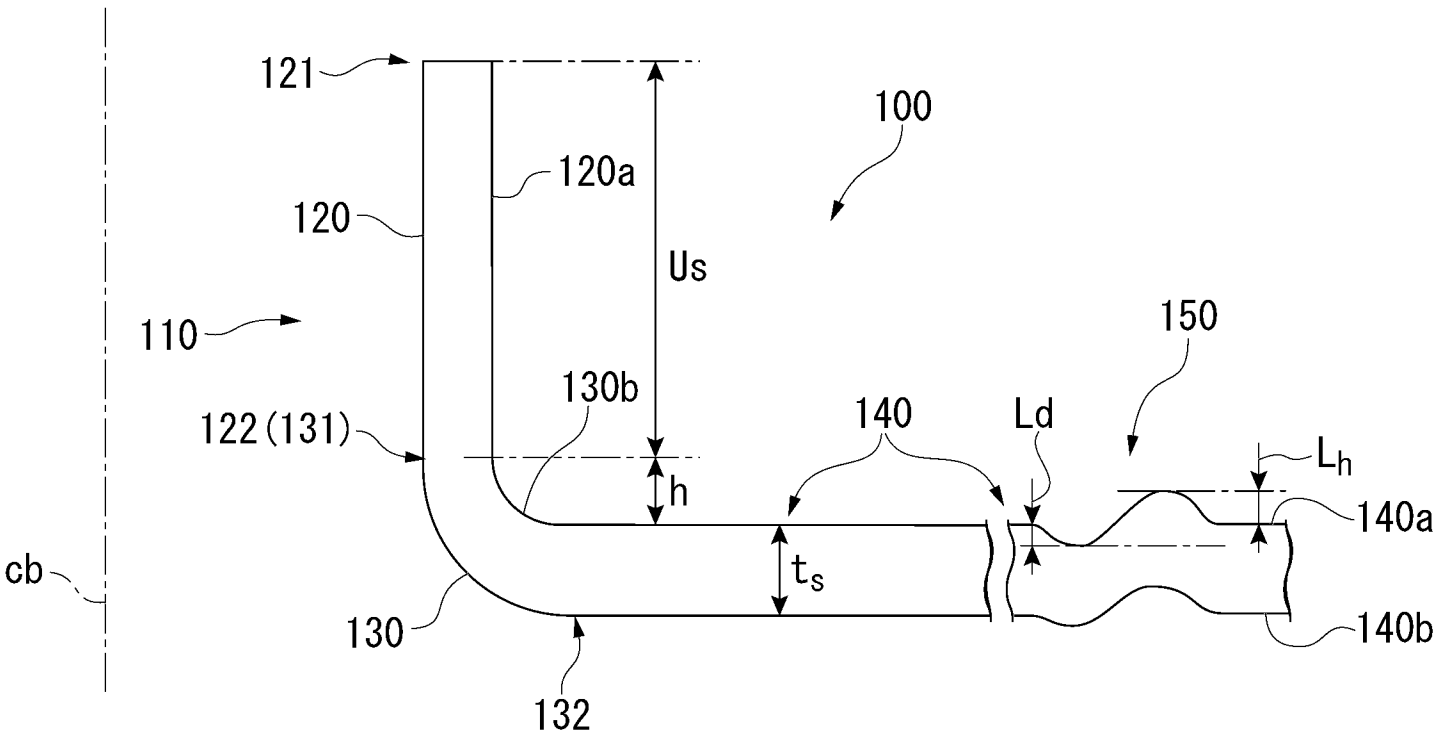
FIG. 19 is a schematic cross-sectional view for explaining an indentation of the burring processed product according to the third embodiment.

Next, an indentation will be described with reference to FIG. 19. FIG. 19 is a partial cross-sectional view of the burring processed product 100 according to the present embodiment, similar to FIG. 18, and is a cross-sectional view of the cross-section passing through the axis cb of the burring processed portion 110 and parallel to the axis cb of the burring processed portion 110. FIG. 19 shows only one side of the burring processed portion 110 around the axis cb. As shown in FIG. 19, an indentation 150 is generated in the peripheral region 140. As illustrated in FIG. 19, the indentation 150 can be generated on any of both surfaces **140*a* and 140*b* in the peripheral region 140 of the buffing processed product 100**.

When a fatigue endurance test in which repeated loads are applied to the burring processed product 100 is performed, fatigue cracks may occur at a position of a bend inner portion of the burring processed portion 110 (an outer circumferential surface **130*b* of the curved portion 130 in FIG. 19). This is because stress is concentrated on the curved portion 130 of the burring processed portion by repeatedly receiving a load in the fatigue endurance test, and deformation starts from this portion. When a load is applied, an angle of the curved portion 130 decreases or increases, and thus fatigue cracks are generated on an inner side of the curved portion 130. On the other hand, in a case in which the peripheral region 140 has the indentation 150 in the range of 0.5×Us or more and 20×Us or less from the R tangent of the curved portion, stress is also generated in the indentation 150 when a load is repeatedly applied, and thus the stress on the bend inner side of the burring processed portion 110 (the outer circumferential surface 130*b* of the curved portion 130) is reduced. That is, the stress applied to the burring processed portion 110 is dispersed. The reason why the stress is also generated in the indentation 150 is that, since unevenness in a direction parallel to the axis cb of the burring processed portion 110 (which may be a thickness direction of the peripheral region 140) is generated in the indentation 150, this unevenness becomes a starting point of deformation. For this reason, presence of the indentation 150** further improves fatigue durability.

The indentation 150 is a portion at which a surface of the burring processed product 100 protrudes to a predetermined height or a portion at which a surface of the burring processed product 100 is depressed to a predetermined depth. As illustrated in FIG. 19, the height of the indentation 150 is a distance Lh in the direction parallel to the axis cb of the burring processed portion 110 from the surface of the burring processed product 100 on the side at which the surface of the burring processed product 100 (the surface 140*a* in the example of FIG. 19) protrudes to a top portion of this protruding portion. The top portion of the protruding portion is the farthest location of the protruding portion separated from the surface of the burring processed product 100 in the direction parallel to the axis cb. The depth of the indentation 150 is a distance Ld in the direction parallel to the axis cb of the buffing processed portion 110 from the surface of the burring processed product 100 on the side at which the surface of the burring processed product 100 (the surface 140*a* in the example of FIG. 19) is depressed to a bottom portion of this depressed portion. The bottom portion of the depressed portion is the farthest location of the depressed portion separated from the surface of the burring processed product 100 in the direction parallel to the axis cb. The surfaces (140*a* and 140*b*) in the peripheral region 140 of the buffing processed product 100 are substantially flat portions excluding the range of the indentation 150. In the burring processed product 100 according to the present embodiment, the maximum height or depth of the indentation 150 is more than ts/20 and less than ts/3.

By setting the maximum height or depth of the indentation 150 to be more than ts/20, a stress dispersion effect on the indentation 150 is sufficiently exhibited. In addition, by setting the maximum height or depth of the indentation 150 to be less than ts/3, fatigue cracking from the indentation 150 can be inhibited. Also, the height Us of the raised portion 120 is a distance from the opening side end portion 121 of the raised portion 120 to the connecting end portion 122 along the axis cb. The R tangent of the curved portion 130 is the base end portion 132 of the curved portion 130. The range of 0.5×Us or more and 20×Us or less from the R tangent of the curved portion 130 is a range in which a distance from the R tangent of the curved portion 130 is 0.5×Us or more and a distance from the R tangent of the curved portion 130 is 20×Us or less in a direction perpendicular to the axis cb and separated from the axis cb, and is a range surrounded by concentric circles centered on the axis cb. In addition, a portion at which the surface of the burring processed product 100 protrudes or is depressed by 2% or more of the thickness is of the burring processed product in the peripheral region 140 in the direction parallel to the axis cb of the burring processed portion 110 is referred to as the indentation 150. The height Lh or depth Ld of the indentation 150 is measured using a contact or non-contact shape measuring instrument.

It is more preferable that the indentation 150 be formed in a shape that draws an arc centered on the axis cb continuously or intermittently within the above range in a plan view in the direction parallel to the axis cb. Also, the indentation 150 may have an elliptical shape in the plan view.

In the burring processed product according to the present embodiment, when the thickness of the burring processed product 100 in the peripheral region 140 is defined as ts, and the height of the outer circumferential surface 130*b* of the curved portion 130 in the direction parallel to the axis cb is defined as h, Expression 8 below may be satisfied.

$$0.2<h/ts<0.6 \quad \text{Expression 8}$$

Here, the height h is a distance from a contact point O between an outer circumferential surface 120*a* of the raised portion 120 and the outer circumferential surface 130*b* of the curved portion 130 to the outer circumferential surface 130*b* at the base end portion 132 of the curved portion 130 in the cross-section passing through the axis cb of the burring processed portion 110 and parallel to the axis cb of the burring processed portion 110, and is a distance in the direction parallel to the axis cb. The height h of the curved portion 130 is preferably 0.6 to 3.0 mm, and more preferably 1.3 to 2.1 mm. Also, as the thickness ts, a sheet thickness at the base end portion 132 of the curved portion 130 as shown in FIG. 18 may be adopted.

In the burring processed product according to the present embodiment, when the thickness of the burring processed product 100 in the peripheral region 140 is defined as ts, and the thickness of the opening side end portion 121 of the raised portion 120 is defined as tb, Expression 9 below may be satisfied. The thickness tb may be an average value of values measured at a plurality of locations (for example, 5 locations) using a measuring instrument such as a micrometer or vernier caliper.

$$tb/ts<0.9 \quad \text{Expression 9}$$

In the buffing processed product according to the present embodiment, there may be no cracks having a depth of 20 μm or more from a surface in the cross-section of the curved portion 130. Thus, there is an advantage of improving crash characteristics. Here, the surface is the outer circumferential surface 130*b* of the curved portion 130. Presence and depths of cracks can be measured by cutting a cross-section and observing it with an optical microscope or the like.

The burring processed product according to the present embodiment can be preferably used for any one of a lower arm, a trailing arm, and an upper arm used in a vehicle.

The buffing processed product according to the present embodiment may be a burring processed product manufactured by the burring processing method according to the first embodiment or the second embodiment.

Also, a burring processing method according to an embodiment of the present invention is a burring processing method for manufacturing the burring processed product according to the third embodiment that is manufactured by the burring processing method according to the first embodiment. Further, a burring processing method according to an embodiment of the present invention is a burring processing method for manufacturing the burring processed product according to the third embodiment that is manufactured by the burring processing method according to the second embodiment.

EXAMPLES

Experimental Example 1

In each experimental example, a pilot hole having a diameter of 40 mm was provided in a steel member having a tensile strength of 980 MPa class and a sheet thickness of 2.9 mm, and burring was performed on the pilot hole by various processing methods, thereby forming a burring processed portion including a curved portion and a raised portion.

In Example 1, burring was performed by the method of the above-described first embodiment. Each dimension of the mold was as follows.

Punch diameter: 50 mm
First die hole diameter: 65.2 mm
Second die hole diameter: 55.2 mm
Radius of curvature of first die shoulder surface of first die: 5 mm In Comparative Example 1, burring was performed by a known method using a single mold. Each dimension of the mold was as follows.

Punch diameter: 50 mm
Die hole diameter: 55.2 mm

In Comparative Example 2, burring was performed by the method of the first embodiment, but with respect to Expression 1 described above, U was 0.5×(P−A)/2 or less, which was a difference between die hole diameters between the first die hole and the second die hole. Each dimension of the mold was as follows.

Punch diameter: 50 mm
First die hole diameter: 57.2 mm
Second die hole diameter: 55.2 mm
Radius of curvature of first die shoulder surface of first die: 5 mm In Comparative Example 3, burring was performed by the method of the first embodiment, but with respect to Expression 1 described above, U was 20×(P−A)/2 or more. Each dimension of the mold was as follows.

Punch diameter: 50 mm
First die hole diameter: 160 mm
Second die hole diameter: 55.2 mm
Radius of curvature of first die shoulder surface of first die: 5 mm Table 1 shows results of presence or absence of cracks of 20 μm or more for the h/t value. Experimental examples in which the cracks of 20 μm or more were observed on the inner side of the curved portion of the burring processed portion of the burring processed product (the outer circumferential surface 130*b* of the curved portion 130 in FIG. 18) were rated as "× (bad)," and experimental examples in which the cracks of 20 μm or more were not observed were rated as "○ (good)." The presence or absence of the cracks was determined by polishing cross-sections of samples cut along a plane passing through the axis of the burring processed portion and observing it with an optical microscope. Twelve samples were collected at equal intervals around the axis cb of the buffing processed portion, and presence or absence of those satisfying the above conditions was determined. Here, h is the height of the outer surface of the curved portion of the burring processed portion on which burring processing is performed, and t is the height of the edge portion of the pilot hole of the steel member.

TABLE 1

| | h/t | | | | | | | | | | | |
|---|---|---|---|---|---|---|---|---|---|---|---|---|
| | 0.10 | 0.15 | 0.20 | 0.22 | 0.30 | 0.50 | 0.58 | 0.60 | 0.65 | 0.70 | 0.80 | 0.90 |
| Example 1 | x | x | x | ○ | ○ | ○ | ○ | ○ | ○ | ○ | ○ | ○ |
| Comparative Example 1 | x | x | x | x | x | x | x | ○ | ○ | ○ | ○ | ○ |
| Comparative Example 2 | x | x | x | x | x | x | x | ○ | ○ | ○ | ○ | ○ |
| Comparative Example 3 | x | x | x | x | x | x | x | ○ | ○ | ○ | ○ | ○ |

As shown in Table 1, it has been understood that generation of the cracks is inhibited in the range in which h/t is more than 0.2 and less than 0.6 among the burring processed products produced by the buffing processing method according to the present invention.

Experimental Example 2

In each experimental example, a pilot hole having a diameter of 12 mm was provided in a steel member (steel sheet) having a tensile strength of 980 MPa class, a sheet thickness of 2.9 mm, and a size of 350 mm×350 mm, and burring was performed on this pilot hole by various processing methods, thereby forming a burring processed portion including a curved portion and a raised portion. An inner diameter of the burring processed portion was 25 mm. A cylindrical jig having an outer diameter corresponding to the inner diameter of the burring processed portion was inserted into the burring processed portion, and the entire circumference of an edge of the burring processed portion and the cylindrical jig were joined together by laser welding to prepare a test piece. The height from a surface of the steel sheet on a side from which the burring processed portion was raised to an opening side end portion of the raised portion was set to 5.0 mm, and the height of an outer surface of the curved portion of the burring processed portion was set to 1.0 mm. That is, the height Us of the raised portion was 4.0 mm.

In Example 1, burring was performed by the method of the above-described first embodiment. Each dimension of the mold was as follows.

Punch diameter: 25 mm
First die hole diameter: 40.2 mm
Second die hole diameter: 30.2 mm
Radius of curvature of first die shoulder surface of first die: 5 mm The burring processed product of Example 1 had an indentation around the burring processed portion, in which, when the height of the raised portion is defined as Us, the maximum height or depth is more than ts/20 and less than ts/3 in the range of 0.5×Us or more and 20×Us or less from the R tangent of the curved portion. That is, as shown in Table 2, the conditions for the position of the indentation and the height or depth of the indentation were satisfied, and the requirements of the present invention were satisfied.

In Comparative Example 1, burring was performed by a known method using a single mold. Each dimension of the mold was as follows.

Punch diameter: 25 mm
Die hole diameter: 30.2 mm
Radius of curvature of die shoulder 1.0 mm No indentation was observed in the burring processed product of Comparative Example 1.

In Comparative Example 2, burring was performed by the method of the above-described first embodiment. Each dimension of the mold was as follows.

Punch diameter: 25 mm

First die hole diameter: 32.2 mm

Second die hole diameter: 30.2 mm

Radius of curvature of first die shoulder surface of first die: 15 mm

An indentation was observed in the burring processed product of Comparative Example 2, but the maximum height or depth of the indentation was ts/20 or less. The indentation was located in the range of 0.5×Us or more and 20×Us or less from the R tangent of the curved portion. That is, as shown in Table 2, the condition for the position of the indentation was satisfied, but a lower limit of the condition for the height or depth of the indentation was not satisfied.

In Comparative Example 3, burring was performed by the method of the above-described first embodiment. Each dimension of the mold was as follows.

Punch diameter: 25 mm

First die hole diameter: 295 mm

Second die hole diameter: 30.2 mm

Radius of curvature of second die shoulder surface of second die: 0.5 mm

An indentation was observed in the burring processed product of Comparative Example 3, but the maximum height or depth of the indentation was ts/3 or more. It is conceivable that an upper limit of the height or depth of the indentation was not satisfied due to a small radius of curvature of the first die. In addition, the indentation was located on a farther side from the burring processed portion than the range of 0.5×Us or more and 20×Us or less from the R tangent of the curved portion. That is, as shown in Table 2, an upper limit of the condition of the position of the indentation was not satisfied, and the upper limit of the condition for the height or depth of the indentation was not satisfied.

In Comparative Example 4, burring was performed by the method of the above-described first embodiment. Each dimension of the mold was as follows.

Punch diameter: 25 mm

First die hole diameter: 295 mm

Second die hole diameter: 30.2 mm

Radius of curvature of second die shoulder surface of second die: 5 mm

The burring processed product of Comparative Example 4 had an indentation having the maximum height or depth of more than ts/20 and less than ts/3. However, the indentation was located on a farther side from the burring processed portion than the range of 0.5×Us or more and 20×Us or less from the R tangent of the curved portion. That is, as shown in Table 2, although the condition for the height or depth of the indentation were satisfied, the upper limit of the condition for the position of the indentation was not satisfied.

A displacement of +2 mm to −2 mm was repeatedly applied to one end portion (side) of the test piece in a direction parallel to the axis of the burring processed portion at 1 Hz, and a load at that time was measured. This measurement was performed on the test piece of each experimental example, and presence or absence of cracks was evaluated at the time when 200,000 times of displacement were applied.

Table 2 shows results of presence or absence of generation of cracks for the indentation conditions. Experimental examples in which cracks of 100 μm or more were observed on the inner side of the curved portion of the burring processed portion of the burring processed product (the outer circumferential surface 130*b* of the curved portion 130 in FIG. 18) at the time when 200,000 times of displacement were applied were rated as "× (bad)," and experimental examples in which the cracks of 100 μm or more were not observed were rated as "○ (good)." The presence or absence of the cracks was determined by polishing cross-sections of samples cut along a plane passing through the axis of the burring processed portion and observing it with an optical microscope. Twelve samples were taken at equal intervals with respect to the axis cb, and the presence or absence of the cracks was visually determined.

TABLE 2

| | Position of indentation | Height or depth of indentation | Presence or absence of cracks |
|---|---|---|---|
| Example 1 | Satisfied | Satisfied | ○ |
| Comparative Example 1 | — | — | × |
| Comparative Example 2 | Satisfied | Low limit unsatisfied | × |
| Comparative Example 3 | Upper limit unsatisfied | Upper limit unsatisfied | × |
| Comparative Example 4 | Upper limit unsatisfied | Satisfied | × |

As shown in Table 2, it has been understood that, among the burring processed products according to the present invention, those satisfying the conditions for the position and the height of the indentation are excellent in fatigue durability.

INDUSTRIAL APPLICABILITY

The present invention can provide a burring processing method, a burring processing mold, a burring processing device, and a buffing processed product in which generation of cracks in a buffing processed portion can be inhibited, and therefore has high industrial applicability.

BRIEF DESCRIPTION OF THE REFERENCE SYMBOLS

1 Metal component
2 Pilot hole
3 First range
4 Preformed portion
5 Second range
6 Third range
100 Burring processed product
110 Burring processed portion
120 Raised portion
130 Curved portion
140 Peripheral region
150 Indentation
1000 Burring processing mold
1100 First die
1111, 2111 Inner wall surface of first die hole
1130, 2130 First die shoulder surface
1200 Second die
1211, 3211 Inner wall surface of second die hole
1230, 3230 Second die shoulder surface
1300 Holder
1310, 2310, 3310 Holder hole
1400 Punch
2000 Preforming mold
3000 Main forming mold
cd Axis of die hole rd1, rd1' Diameter of first die hole rd2, rd2' Diameter of second die hole ro2 Outer diameter of second support surface

The invention claimed is:

1. A burring processing method, which is a method for forming a burring processed portion including a raised portion and a curved portion in a metal component having a pilot hole formed therein, the metal component being a steel member having a thickness of 1.8 to 4.2 mm at a location the burring processing method is performed, using a burring processing mold including:

a first die that includes a first die hole and a first support surface perpendicular to an axis of the first die hole, and a second die that includes a second die hole and a second support surface perpendicular to an axis of the second die hole;

a holder that includes a third support surface facing the first support surface and the second support surface and holds the metal component between the first die and the second die; and a punch that includes a shaft portion and is movably provided along the axis of the first die hole and the axis of the second die hole, in which the first support surface, the second support surface, and the third support surface are disposed parallel to each other, a diameter of the second die hole is smaller than a diameter of the first die hole, and an outer diameter of the second support surface is smaller than the diameter of the first die hole, the method comprising:

a preforming step of enlarging a diameter of the pilot hole, moving an edge portion of the pilot hole relative to the metal component in a first direction of a thickness direction of the metal component in a first range around the pilot hole of the metal component, and forming a whole first range into a preformed portion raised from the metal component in the first direction; and a main forming step of deforming the preformed portion in a second direction opposite to the first direction, forming a second range on an outer diameter side of the preformed portion to have a same height as the first range in the first direction, and forming part of a third range on an inner diameter side of the preformed portion from the second range to be part of the curved portion and the raised portion, wherein an outer diameter of the curved portion is smaller than an outer diameter of the preformed portion, a maximum radius of curvature of the curved portion is smaller than the minimum radius of curvature of the preformed portion in a cross-sectional view parallel to the first direction and passing through a center of the pilot hole, the preformed portion is formed between the punch and the first die by holding the metal component between the first support surface of the first die and the third support surface of the holder and moving the punch relative to the first die in the first direction to insert the punch through the first die hole, the burring processed portion is formed between the second die, the punch, and the holder by moving the second die relative to the holder in the second direction to insert part of the second die between the punch and the first die in a state in which the metal component is held between the first support surface and the third support surface, when a difference between a radius of the first die hole and a radius of the second die hole is defined as U, a diameter of the shaft portion of the punch is defined as P, and the diameter of the pilot hole of the metal component is defined as A, Expression 1 below is satisfied, and when a height of the edge portion of the pilot hole of the metal component is defined as t, and a height of an outer surface of the curved portion in the first direction is defined as h, Expression 2 below is satisfied, $$0.5\times(P-A)/2<U<20\times(P-A)/2 \quad \text{Expression 1}$$

$$0.2<h/t<0.6 \quad \text{Expression 2.}$$

2. The burring processing method according to claim 1, wherein a tensile strength of the metal component is 780 MPa or more.

3. The burring processing method according to claim 1, wherein, when the height of the edge portion of the pilot hole of the metal component is defined as t, and a thickness of an opening side end portion of the raised portion is defined as tb, Expression 4 below is satisfied, $$tb/t<0.9 \quad \text{Expression 4.}$$

4. The burring processing method according to claim 1, further comprising a pilot hole forming step of forming the pilot hole in the metal component before the preforming step.

* * * * *